US007762293B2

(12) United States Patent
Pervan

(10) Patent No.: US 7,762,293 B2
(45) Date of Patent: Jul. 27, 2010

(54) EQUIPMENT FOR THE PRODUCTION OF BUILDING PANELS

(75) Inventor: Darko Pervan, Viken (SE)

(73) Assignee: Valinge Innovation AB, Viken (SE)

( * ) Notice: Subject to any disclaimer, the term of this patent is extended or adjusted under 35 U.S.C. 154(b) by 0 days.

(21) Appl. No.: 11/822,720

(22) Filed: Jul. 9, 2007

(65) Prior Publication Data

US 2008/0005999 A1 Jan. 10, 2008

Related U.S. Application Data

(63) Continuation of application No. 11/034,060, filed on Jan. 13, 2005, now Pat. No. 7,516,588.

(60) Provisional application No. 60/537,891, filed on Jan. 22, 2004.

(30) Foreign Application Priority Data

Jan. 13, 2004 (SE) ..... 0400068

(51) Int. Cl.
*B27F 5/02* (2006.01)

(52) U.S. Cl. ..... 144/82

(58) Field of Classification Search ..... 52/578, 52/588.1, 589.1, 591.1–592.6; 198/345.1, 198/606, 626.4–626.6; 144/82, 136.1, 367, 144/2.1, 3.1, 1.1, 134.1, 137; 83/875, 877
See application file for complete search history.

(56) References Cited

U.S. PATENT DOCUMENTS

| | | | | |
|---|---|---|---|---|
| 168,672 | A | 10/1875 | Reed | |
| 1,787,027 | A | 12/1930 | Wasleff | |
| 1,898,364 | A | 2/1933 | Gynn | |
| 2,387,446 | A * | 10/1945 | Herz | 198/626.6 |
| 2,430,200 | A | 11/1947 | Wilson | |
| 2,497,837 | A | 2/1950 | Nelson | |
| 2,740,167 | A | 4/1956 | Rowley | |
| 2,805,852 | A | 9/1957 | Malm | |
| 3,347,048 | A * | 10/1967 | Brown et al. | 52/592.4 |
| 3,387,422 | A | 6/1968 | Wanzer | |
| 3,538,665 | A | 11/1970 | Gohner | |
| 3,694,983 | A | 10/1972 | Couquet | |
| 3,720,027 | A | 3/1973 | Christensen | |
| 3,729,368 | A | 4/1973 | Ingham | |
| 3,738,404 | A * | 6/1973 | Walker | 144/136.1 |
| 3,842,562 | A | 10/1974 | Daigle | |

(Continued)

FOREIGN PATENT DOCUMENTS

| | | |
|---|---|---|
| AT | 218725 B | 12/1961 |

(Continued)

OTHER PUBLICATIONS

International Search Report issued in corres. PCT/SE2005/000030 (Published as WO 2005/068747 A1), Apr. 27, 2004.

*Primary Examiner*—Richard E Chilcot, Jr.
*Assistant Examiner*—Matthew J Smith
(74) *Attorney, Agent, or Firm*—Buchanan Ingersoll & Rooney PC

(57) ABSTRACT

Floorboards with a mechanical locking system that allows movement between the floorboards when they are joined to form a floating floor.

13 Claims, 12 Drawing Sheets

U.S. PATENT DOCUMENTS

| | | | | |
|---|---|---|---|---|
| 3,859,000 | A | 1/1975 | Webster | |
| 3,916,965 | A | 11/1975 | Attridge et al. | |
| 3,927,705 | A * | 12/1975 | Cromeens et al. | 144/91.2 |
| 4,028,450 | A * | 6/1977 | Gould | 52/309.1 |
| 4,169,688 | A | 10/1979 | Toshio | |
| 4,196,554 | A | 4/1980 | Anderson | |
| 4,219,056 | A | 8/1980 | Lindstrom | |
| 4,230,163 | A | 10/1980 | Barton | |
| 4,281,696 | A | 8/1981 | Howard et al. | |
| 4,426,820 | A | 1/1984 | Terbrack | |
| 4,819,932 | A | 4/1989 | Trotter, Jr. | |
| 4,930,386 | A | 6/1990 | Laskowski et al. | |
| 5,148,850 | A | 9/1992 | Urbanick | |
| 5,165,816 | A * | 11/1992 | Parasin | 52/592.4 |
| 5,213,861 | A | 5/1993 | Severson et al. | |
| 5,216,861 | A | 6/1993 | Meyerson | |
| 5,253,464 | A | 10/1993 | Nilsen | |
| 5,274,979 | A | 1/1994 | Tsai | |
| 5,295,341 | A | 3/1994 | Kajiwara | |
| 5,425,986 | A | 6/1995 | Guyette | |
| 5,587,218 | A | 12/1996 | Betz | |
| 5,695,875 | A | 12/1997 | Larsson | |
| 5,755,068 | A | 5/1998 | Ormiston | |
| 5,899,251 | A | 5/1999 | Turner | |
| 5,954,915 | A | 9/1999 | Voorhees et al. | |
| 6,006,486 | A * | 12/1999 | Moriau et al. | 52/589.1 |
| 6,021,615 | A | 2/2000 | Brown | |
| 6,189,283 | B1 | 2/2001 | Bentley | |
| 6,226,951 | B1 | 5/2001 | Azar | |
| 6,332,733 | B1 | 12/2001 | Hamberger et al. | |
| 6,345,481 | B1 | 2/2002 | Nelson | |
| 6,421,970 | B1 | 7/2002 | Martensson et al. | |
| 6,446,405 | B1 | 9/2002 | Pervan | |
| 6,497,079 | B1 | 12/2002 | Pletzer et al. | |
| 6,505,452 | B1 * | 1/2003 | Hannig et al. | 52/592.1 |
| 6,510,665 | B2 * | 1/2003 | Pervan | 52/589.1 |
| 6,521,314 | B2 | 2/2003 | Tychsen | |
| 6,536,178 | B1 | 3/2003 | Palsson et al. | |
| 6,647,689 | B2 * | 11/2003 | Pletzer et al. | 52/592.1 |
| 6,647,690 | B1 | 11/2003 | Martensson | |
| 6,763,643 | B1 | 7/2004 | Martensson | |
| 6,769,218 | B2 * | 8/2004 | Pervan | 52/591.4 |
| 6,851,241 | B2 * | 2/2005 | Pervan | 52/592.1 |
| 6,898,913 | B2 * | 5/2005 | Pervan | 52/589.1 |
| 7,047,697 | B1 | 5/2006 | Heath | |
| 7,137,229 | B2 | 11/2006 | Pervan | |
| 7,171,791 | B2 * | 2/2007 | Pervan | 52/592.1 |
| 7,356,971 | B2 * | 4/2008 | Pervan | 52/592.2 |
| 2002/0007609 | A1 | 1/2002 | Pervan | |
| 2002/0020127 | A1 | 2/2002 | Thiers et al. | |
| 2002/0056245 | A1 | 5/2002 | Thiers | |
| 2002/0178674 | A1 | 12/2002 | Pervan | |
| 2002/0178682 | A1 | 12/2002 | Pervan | |
| 2002/0189183 | A1 | 12/2002 | Ricciardelli | |
| 2003/0029116 | A1 | 2/2003 | Moriau et al. | |
| 2003/0079820 | A1 | 5/2003 | Palsson et al. | |
| 2003/0154681 | A1 | 8/2003 | Pletzer et al. | |
| 2004/0045254 | A1 | 3/2004 | Vander Heijden | |
| 2004/0139678 | A1 | 7/2004 | Pervan | |
| 2004/0255541 | A1 | 12/2004 | Thiers et al. | |
| 2005/0034404 | A1 * | 2/2005 | Pervan | 52/578 |
| 2005/0166514 | A1 | 8/2005 | Pervan | |
| 2005/0166516 | A1 | 8/2005 | Pervan | |
| 2005/0193675 | A1 | 9/2005 | Smart et al. | |
| 2006/0032168 | A1 | 2/2006 | Thiers et al. | |
| 2006/0196139 | A1 | 9/2006 | Pervan et al. | |
| 2006/0283127 | A1 | 12/2006 | Pervan | |
| 2007/0175144 | A1 | 8/2007 | Pervan | |
| 2008/0000190 | A1 | 1/2008 | Pervan | |
| 2008/0000194 | A1 | 1/2008 | Pervan et al. | |
| 2008/0005997 | A1 | 1/2008 | Pervan | |
| 2008/0005998 | A1 | 1/2008 | Pervan | |
| 2008/0028713 | A1 | 2/2008 | Pervan et al. | |
| 2008/0060308 | A1 * | 3/2008 | Pervan | 52/588.1 |
| 2008/0168730 | A1 | 7/2008 | Pervan et al. | |
| 2008/0168736 | A1 | 7/2008 | Pervan | |
| 2008/0168737 | A1 | 7/2008 | Pervan | |
| 2008/0209837 | A1 | 9/2008 | Pervan | |
| 2008/0209838 | A1 | 9/2008 | Pervan | |

FOREIGN PATENT DOCUMENTS

| | | | |
|---|---|---|---|
| DE | 1 212 275 | B | 3/1966 |
| DE | 2 159 042 | A1 | 6/1973 |
| DE | 26 16 077 | A1 | 10/1977 |
| DE | 33 43 601 | A1 | 6/1985 |
| DE | 33 43 601 | C2 | 6/1985 |
| DE | 42 42 530 | A1 | 6/1994 |
| DE | 296 18 318 | U1 | 5/1997 |
| DE | 19718 319 | A1 | 11/1998 |
| DE | 19718 812 | A1 | 11/1998 |
| DE | 202 06 460 | U1 | 7/2002 |
| DE | 203 07 580 | U1 | 7/2003 |
| DE | 102 32 508 | C1 | 12/2003 |
| EP | 1 317 983 | A2 | 6/2003 |
| EP | 1 317 983 | A3 | 6/2003 |
| FR | 1 293 043 | A | 4/1962 |
| GB | 812671 | A | 4/1959 |
| GB | 1 430 423 | A | 3/1976 |
| GB | 2 256 023 | A | 11/1992 |
| JP | 1-178659 | A | 7/1989 |
| JP | 3-169967 | A | 7/1991 |
| JP | 7-180333 | A | 7/1995 |
| JP | 7-300979 | A | 11/1995 |
| JP | 7-310426 | A | 11/1995 |
| JP | 8-109734 | A | 4/1996 |
| JP | 10-219975 | A | 8/1998 |
| JP | 2000-226932 | A | 8/2000 |
| JP | 2001-254503 | A | 9/2001 |
| SE | 372 051 | B | 12/1974 |
| SE | 450 141 | B | 6/1987 |
| WO | WO 84/02155 | A1 | 6/1984 |
| WO | WO 93/13280 | A | 7/1993 |
| WO | WO 94/26999 | A1 | 11/1994 |
| WO | WO 97/47834 | A1 | 12/1997 |
| WO | WO 98/38401 | A1 | 9/1998 |
| WO | WO 99/66152 | A1 | 12/1999 |
| WO | WO 00/20705 | A1 | 4/2000 |
| WO | WO 00/66856 | A1 | 11/2000 |
| WO | WO 01/66877 | A1 | 9/2001 |
| WO | WO 02/055809 | A1 | 7/2002 |
| WO | WO 02/055810 | A1 | 7/2002 |
| WO | WO 03/025307 | A1 | 3/2003 |
| WO | WO 03/083234 | A1 | 10/2003 |
| WO | WO 03/089736 | A1 | 10/2003 |

* cited by examiner

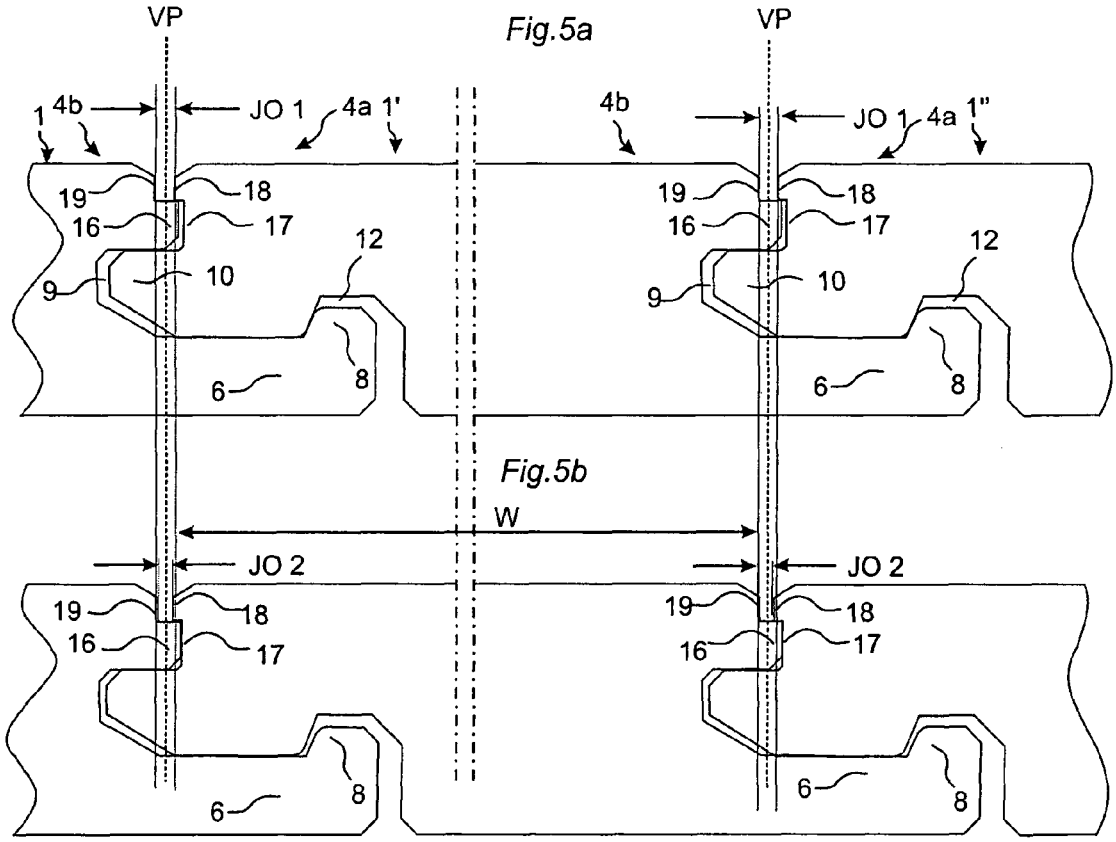
Fig.5c
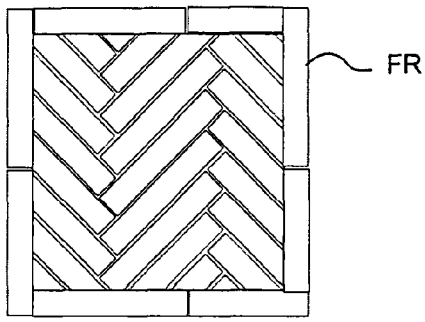
Fig.5d
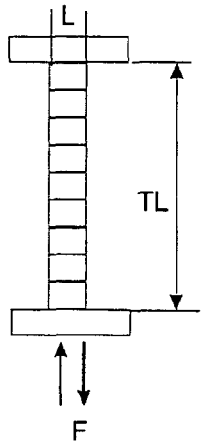

EQUIPMENT FOR THE PRODUCTION OF BUILDING PANELS

CROSS-REFERENCE TO RELATED APPLICATIONS

The present application claims priority of Swedish Patent Application No. 0400068-3, filed in Sweden on Jan. 13, 2004 and U.S. Provisional Application No. 60/537,891, filed in the United States on Jan. 22, 2004, the entire contents of which are hereby incorporated herein by reference. This application is a continuation of Ser. No. 11/034,060, filed 13 Jan. 2005, now U.S. Pat. No. 7,516,588, issued 14 Apr. 2009.

FIELD OF THE INVENTION

The invention relates generally to the technical field of locking systems for floorboards. The invention concerns on the one hand a locking system for floorboards which can be joined mechanically and, on the other hand, floorboards and floor systems provided with such a locking system and a production method to produce such floorboards.

The present invention is particularly suited for use in floating wooden floors and laminate floors, such as massive wooden floors, parquet floors, floors with a surface of veneer, laminate floors with a surface layer of high pressure laminate or direct laminate and the like.

The following description of prior-art technique, problems of known systems as well as objects and features of the invention will therefore as non-limiting examples be aimed mainly at this field of application. However, it should be emphasized that the invention can be used in any floorboards, which are intended to be joined in different patterns by means of a mechanical locking system. The invention may thus also be applicable to floors which are glued or nailed to the sub floor or floors with a core and with a surface of plastic, linoleum, cork, varnished fiberboard surface and the like.

DEFINITION OF SOME TERMS

In the following text, the visible surface of the installed floorboard is called "front side", while the opposite side of the floorboard facing the subfloor is called "rear side". By "floor surface" is meant the major outer flat part of the floorboard, which is opposite to the rear side and which is located in one single plane. Bevels, grooves and similar decorative features are parts of the front side but they are not parts of the floor surface. By "laminate floor" is meant a floor having a surface, which consists of melamine impregnated paper, which has been compressed under pressure and heat. "Horizontal plane" relates to a plane, which is extended parallel to the outer part of the floor surface. "Vertical plane" relates to a plane perpendicular to the horizontal plane.

The outer parts of the floorboard at the edge of the floorboard between the front side and the rear side are called "joint edge". By "joint edge portion" is meant a part of the joint edge of the floorboard. By "joint" or "locking system" are meant cooperating connecting means, which interconnect the floorboards vertically and/or horizontally. By "mechanical locking system" is meant that joining can take place without glue. Mechanical locking systems can in many cases also be joined by glue. By "vertical locking" is meant locking parallel to the vertical plane. As a rule, vertical locking consists of a tongue, which cooperates with a tongue groove. By "horizontal locking" is meant locking parallel to the horizontal plane. By "joint opening" is meant a groove which is defined by two joint edges of two joined floorboards and which is open to the front side. By "joint gap" is meant the minimum distance between two joint edge portions of two joined floorboards within an area, which is defined by the front side and the upper part of the tongue next to the front side. By "open joint gap" is meant a joint gap, which is open towards the front side. By "visible joint gap" is meant a joint gap, which is visible to the naked eye from the front side for a person walking on the floor, or a joint gap, which is larger than the general requirements on joint gaps established by the industry for various floor types. With "continuous floating floor surface" is meant a floor surface, which is installed in one piece without expansion joints.

BACKGROUND OF THE INVENTION

Traditional laminate and parquet floors are usually installed floating on an existing subfloor. The joint edges of the floorboards are joined to form a floor surface, and the entire floor surface can move relative to the subfloor. As the floorboards shrink or swell in connection with the relative humidity RH varying during the year, the entire floor surface will change in shape.

Floating floors of this kind are usually joined by means of glued tongue and groove joints. In laying, the boards are brought together horizontally, a projecting tongue along the joint edge of one board being inserted into a tongue groove along the joint edge of an adjoining board. The tongue and groove joint positions and locks the floorboards vertically and the glue locks the boards horizontally. The same method is used on both long side and short side, and the boards are usually laid in parallel rows long side against long side and short side against short side.

In addition to such traditional floating floors, which are joined by means of glued tongue and groove joints, floorboards have been developed in recent years, which do not require the use of glue but which are instead joined mechanically by means of so-called mechanical locking systems. These systems comprise locking means, which lock the boards mechanically horizontally and vertically without glue. The vertical locking means are generally formed as a tongue, which cooperates with a tongue grove. The horizontal locking means comprising a locking element, which cooperates with a locking groove. The locking element could be formed on a strip extending from the lower part of the tongue groove or it could be formed on the tongue. The mechanical locking systems can be formed by machining the core of the board. Alternatively, parts of the locking system such as the tongue and/or the strip can be made of a separate material, which is integrated with the floorboard, i.e., already joined with the floorboard in connection with the manufacture thereof at the factory.

The floorboards can be joined mechanically by various combinations of angling, snapping-in, vertical change of position such as the so-called vertical folding and insertion along the joint edge. All of these installation methods, except vertical folding, require that one side of the floorboard, the long or short side, could be displaced in locked position. A lot of locking systems on the market are produced with a small play between the locking element and the locking grove in order to facilitate displacement. The intention is to produce floorboards, which are possible to displace, and which at the same time are connected to each other with a fit, which is as tight as possible. A very small displacement play of for instance 0.01-0.05 mm is often sufficient to reduce the friction between wood fibers considerably. According to The European Standard EN 13329 for laminate floorings joint openings between floorboards should be on an average $\leqq 0.15$ mm and the maximum level in a floor should be ≦0.20 mm. The aim of all producers of floating floors is to reduce the joint openings as much as possible. Some floors are even produced with a pre-tension where the strip with the locking element in locked position is bended backwards towards the sub floor and where the locking element and the locking groove press the panels tightly against each other. Such a floor is difficult to install.

Wooden and laminate floors are also joined by gluing or nailing to the subfloor. Such gluing/nailing counteracts movements due to moisture and keeps the floorboards joined. The movement of the floorboards occurs about a center in each floorboard. Swelling and shrinking can occur by merely the respective floorboards, and thus not the entire floor surface, changing in shape.

Floorboards that are joined by gluing/nailing to the subfloor do not require any locking systems at all. However, they can have traditional tongue and groove joints, which facilitate vertical positioning. They can also have mechanical locking systems, which lock and position the floorboards vertically and/or horizontally in connection with laying.

RELATED ART

The advantage of floating flooring is that a change in shape due to different degrees of relative humidity RH can occur concealed under baseboards and the floorboards can, although they swell and shrink, be joined without visible joint gaps. Installation can, especially by using mechanical locking systems, take place quickly and easily and the floor can be taken up and be laid once more in a different place. The drawback is that the continuous floor surface must as a rule be limited even in the cases where the floor consists of relatively dimensionally stable floorboards, such as laminate floor with a fiberboard core or wooden floors composed of several layers with different fiber directions. The reason is that such dimensionally stable floors as a rule have a change in dimension, which is about 0.1% corresponding to about 1 mm per meter when the RH varies between 25% in winter and 85% in summer. Such a floor will, for example, over a distance of ten meters shrink and swell about 10 mm. A large floor surface must be divided into smaller surfaces with expansion strips, for example, every tenth or fifteenth meter. Without such a division, it is a risk that the floor when shrinking will change in shape so that it will no longer be covered by baseboards. Also the load on the locking system will be great since great loads must be transferred when a large continuous surface is moving. The load will be particularly great in passages between different rooms.

According to the code of practice established by the European Producers of Laminate Flooring (EPLF), expansion joint profiles should be installed on surfaces greater than 12 m in the direction of the length of the individual flooring planks and on surfaces greater than 8 m in the width direction. Such profiles should also be installed in doorways between rooms. Similar installation guidelines are used by producers of floating floors with a surface of wood. Expansion joint profiles are generally aluminum or plastic section fixed on the floor surface between two separate floor units. They collect dirt, give an unwanted appearance and are rather expensive. Due to these limitations on maximum floor surfaces, laminate floorings have only reached a small market share in commercial applications such as hotels, airports, and large shopping areas.

Unstable floors, such as homogenous wooden floors, may exhibit still greater changes in shape. The factors that above all affect the change in shape of homogenous wooden floors are fiber direction and kind of wood. A homogenous oak floor is very stable along the fiber direction, i.e., in the longitudinal direction of the floorboard. In the transverse direction, the movement can be 3% corresponding to 30 mm per meter or more as the RH varies during the year. Other kinds of wood exhibit still greater changes in shape. Floorboards exhibiting great changes in shape can as a rule not be installed floating. Even if such an installation would be possible, the continuous floor surface must be restricted significantly.

The advantage of gluing/nailing to the subfloor is that large continuous floor surfaces can be provided without expansion joint profiles and the floor can take up great loads. A further advantage is that the floorboards do not require any vertical and horizontal locking systems, and they can be installed in advanced patterns with, for example, long sides joined to short sides. This method of installation involving attachment to the subfloor has, however, a number of considerable drawbacks. The main drawback is that as the floorboards shrink, a visible joint gap arises between the boards. The joint gap can be relatively large, especially when the floorboards are made of moisture sensitive wood materials. Homogenous wooden floors that are nailed to a subfloor can have joint gaps of 3-5 mm. The distance between the boards can be irregularly distributed with several small and some large gaps, and these gaps are not always parallel. Thus, the joint gap can vary over the length of the floorboard. The large joint gaps contain a great deal of dirt, which penetrates down to the tongue and prevents the floorboards from taking their original position in swelling. The installation methods are time-consuming, and in many cases the subfloor must be adjusted to allow gluing/nailing to the subfloor.

It would therefore be a great advantage if it were possible to provide a floating floor without the above drawbacks, in particular a floating floor which a) May comprise a large continuous surface without expansion joint profiles,
b) May comprise moisture sensitive floorboards, which exhibit great dimensional changes as the RH varies during the year.

SUMMARY

The present invention relates to locking systems, floorboards and floors which make it possible to install floating floors in large continuous surfaces and with floorboards that exhibit great dimensional changes as the relative humidity (RH) changes. The invention also relates to production methods and production equipment to produce such floors.

A first object of the present invention is to provide a floating floor of rectangular floorboards with mechanical locking systems, in which floor the size, pattern of laying and locking system of the floorboards cooperate and allow movements between the floorboards. According to an embodiment of the invention, the individual floorboards can change in shape after installation, i.e., shrink and swell due to changes in the relative humidity. This can occur in such a manner that the change in shape of the entire floor surface can be reduced or preferably be eliminated while at the same time the floorboards remain locked to each other without large visible joint gaps.

A second object is to provide locking systems, which allow a considerable movement between floorboards without large and deep dirt-collecting joint gaps and/or where open joint gaps could be excluded. Such locking systems are particularly suited for moisture sensitive materials, such as wood, but also when large floating floors are installed using wide and/or long floorboards.

The terms long side and short side are used in the description to facilitate understanding. The boards can according to the invention also be square or alternately square and rectangular, and optionally also exhibit different patterns and angles between opposite sides.

It should be particularly emphasized that the combinations of floorboards, locking systems and laying patterns that appear in this description are only examples of suitable embodiments. A large number of alternatives are conceivable. All the embodiments that are suitable for the first object of the invention can be combined with the embodiments that describe the second object of the invention. All locking systems can be used separately in long sides and/or short sides and also in various combinations on long sides and short sides. The locking systems having horizontal and vertical locking means can be joined by angling and/or snapping-in. The geometries of the locking systems and the active horizontal and vertical locking means can be formed by machining the edges of the floorboard or by separate materials being formed or alternatively machined before or after joining to the joint edge portion of the floorboard.

According to a first embodiment, a floating floor comprises rectangular floorboards, which are joined by a mechanical locking system. The joined floorboards have a horizontal plane, which is parallel to the floor surface, and a vertical plane, which is perpendicular to the horizontal plane. The locking system has mechanically cooperating locks for vertical joining parallel to the vertical plane and for horizontal joining parallel to the horizontal plane of a first and a second joint edge. The vertical locks comprise a tongue, which cooperates with a groove, and the horizontal locks comprise a locking element with a locking surface cooperating with a locking groove. The format, installation pattern and locking system of the floorboards are designed in such a manner that a floor surface of 1*1 meter can change in shape in at least one direction at least 1 mm when the floorboards are pressed together or pulled apart. This change in shape can occur without visible joint gaps.

According to a second embodiment, a locking system is provided for mechanical joining of floorboards, in which locking system the joined floorboards have a horizontal plane which is parallel to the floor surface and a vertical plane which is perpendicular to the horizontal plane. The locking system has mechanically cooperating locks for vertical joining parallel to the vertical plane and for horizontal joining parallel to the horizontal plane of a first and a second joint edge. The vertical locks comprise a tongue, which cooperates with a groove and the horizontal of a locking element with a locking surface, which cooperates with a locking groove. The first and the second joint edge have upper and lower joint edge portions located between the tongue and the floor surface. The upper joint edge portions are closer to the floor surface than the lower. When the floorboards are joined and pressed against each other, the two upper joint edge portions are spaced from each other and one of the upper joint edge portions in the first joint edge overlaps a lower joint edge portion in the second joint edge.

According to several preferred embodiments of this invention, it is an advantage if the floor comprises rather small floorboards and many joints, which could compensate swelling and shrinking. The production tolerances should be rather small since well-defined plays and joint openings are generally required to produce a high quality floor according to the invention.

Small floorboards are however difficult to produce with the required tolerance since they have a tendency to turn in an uncontrolled manner during machining. The main reason why small floorboards are more difficult to produce than large floorboards is that large floorboard has a much large area, which is in contact with a chain and a belt during the machining of the edges of the floorboards. This large contact area keeps the floorboards fixed by the belt to the chain in such a way that they cannot move or turn in relation to the feeding direction, which may be the case when the contact area is small.

Production of floorboards is essentially carried out in such manner that a set of tools and a floorboard blank are displaced relative to each other. A set of tools comprises preferably one or more milling tools which are arranged and dimensioned to machine a locking system in a manner known to those skilled in the art.

The most used equipment is an end tenor, double or single, where a chain and a belt are used to move the floorboard with great accuracy along a well defined feeding direction. Pressure shoes and support unites are used in many applications together with the chain and the belt mainly to prevent vertical deviations. Horizontal deviation of the floorboard is only prevented by the chain and the belt.

The problem is that in many applications this is not sufficient, especially when panels are small.

A third object of the present invention is to provide equipment and production methods which make it possible to produce floorboards and mechanical locking systems with an end tenor but with better precision than what is possible to accomplish with known technology.

Equipment for production of building panels, especially floorboards, comprises a chain, a belt, a pressure shoe and a tool set. The chain and the belt are arranged to displace the floorboard relative the tool set and the pressure shoe, in a feeding direction. The pressure shoe is arranged to press towards the rear side of the floorboard. The tool set is arranged to form an edge portion of the floorboard when the floorboard is displaced relative the tool set. One of the tools of the tool set forms a guiding surface in the floorboard. The pressure shoe has a guiding device, which cooperates with the guiding surface and prevents deviations in a direction perpendicular to the feeding direction and parallel to the rear side of the floorboard.

It is known that a grove could be formed on the rear side of a floorboard and that a ruler could be inserted into the groove to guide the floorboards when they are displaced by a belt that moves the boards on a table. It is not known that special guiding surfaces and guiding devices could be used in an end tenor where a pressure shoe cooperates with a chain.

A fourth object of the present invention is to provide a large semi-floating floor of rectangular floorboards with mechanical locking systems, in which floor the format, installation pattern and locking system of the floorboards are designed in such a manner that a large semi-floating continuous surface, with length or width exceeding 12 m, could be installed without expansion joints.

BRIEF DESCRIPTION OF THE DRAWINGS

FIGS. 5*a*-5*d* show joined floorboards and testing methods.

DETAILED DESCRIPTION OF THE PREFERRED EMBODIMENTS

Figure 1A:
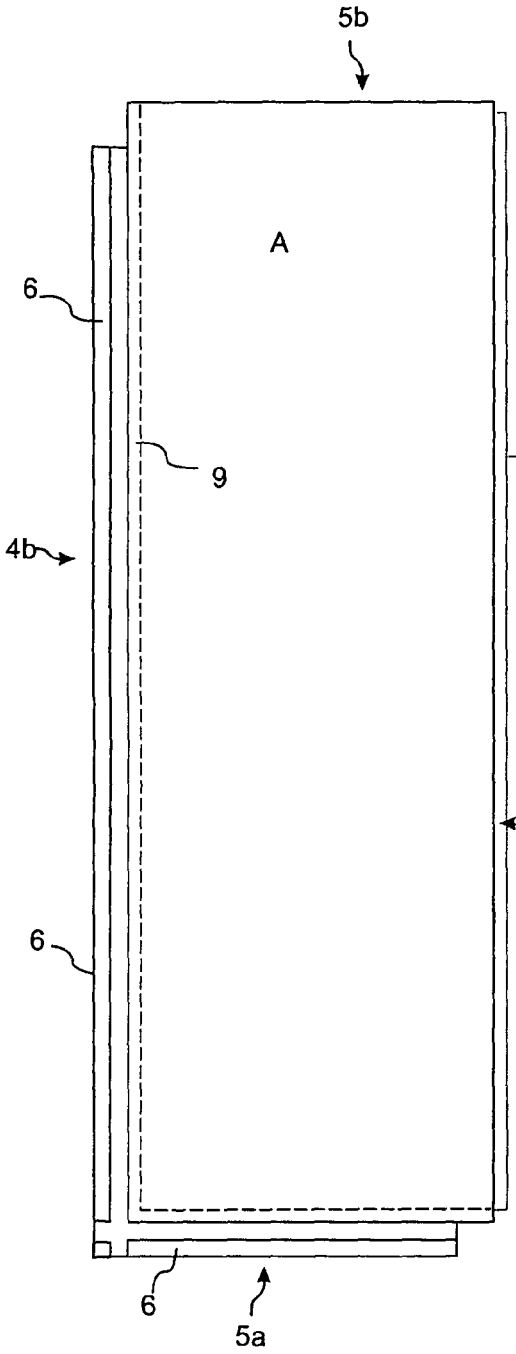
FIGS. 1*a*-1*b* show floorboards with locking system.
Figure 1B:
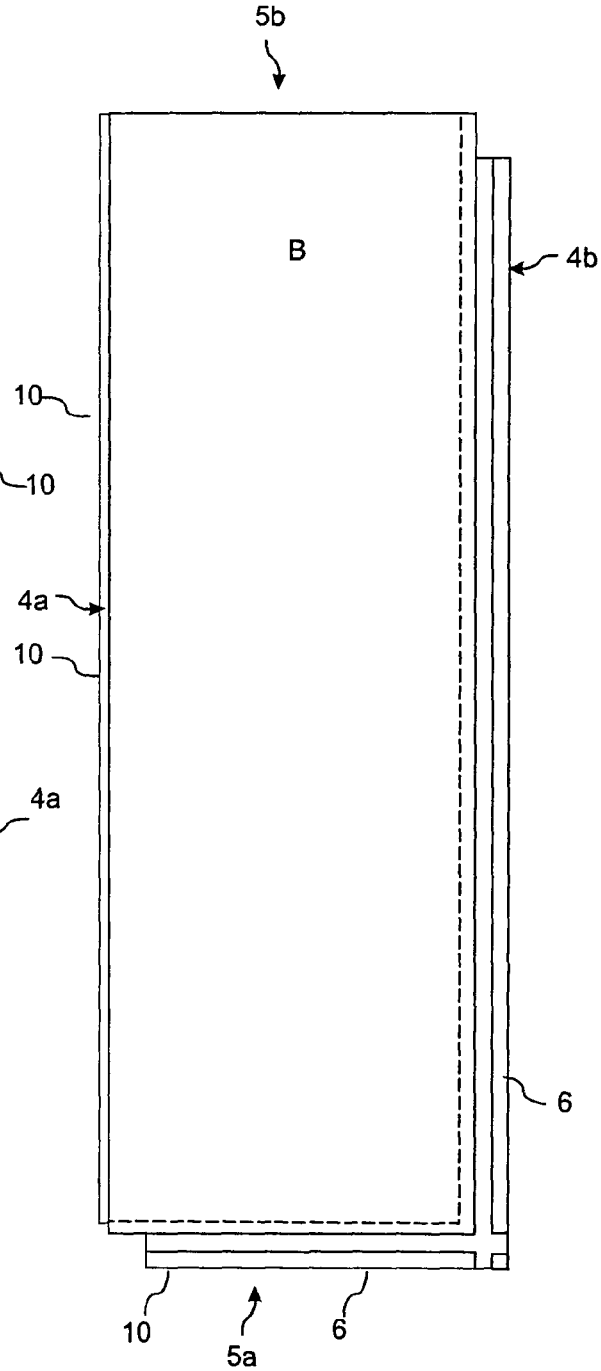

FIGS. 1*a* and 1*b* illustrate floorboards which are of a first type A and a second type B according to the invention and whose long sides 4*a* and 4*b* in this embodiment have a length which is 3 times the length of the short sides 5*a*, 5*b*. The long sides 4*a*, 4*b* of the floorboards have vertical and horizontal connectors, and the short sides 5*a*, 5*b* of the floorboards have horizontal connectors. In this embodiment, the two types are identical except that the location of the locks is mirror-inverted. The locks allow joining of long side 4*a* to long side 4*b* by at least inward angling and long side 4*a* to short side 5*a* by inward angling, and also short side 5*b* to long side 4*b* by a vertical motion. Joining of both long sides 4*a*, 4*b* and short sides 5*a*, 5*b* in a herringbone pattern or in parallel rows can in this embodiment take place merely by an angular motion along the long sides 4*a*, 4*b*. The long sides 4*a*, 4*b* of the floorboards have connectors, which in this embodiment comprising a strip 6, a tongue groove 9 and a tongue 10. The short sides 5*a* also have a strip 6 and a tongue groove 9 whereas the short sides 5*b* have no tongue 10. There may be a plurality of variants. The two types of floorboards need not be of the same format and the locking means can also have different shapes, provided that as stated above they can be joined long side against short side. The connectors can be made of the same material, or of different materials, or be made of the same material but with different material properties. For instance, the connectors can be made of plastic or metal. They can also be made of the same material as the floorboard, but be subjected to a treatment modifying their properties, such as impregnation or the like. The short sides 5*b* can have a tongue and the floorboards can then be joined in prior-art manner in a diamond pattern by different combinations of angular motion and snap motions. Short sides could also have a separate flexible tongue, which during locking could be displaced horizontally.

Figure 2A:
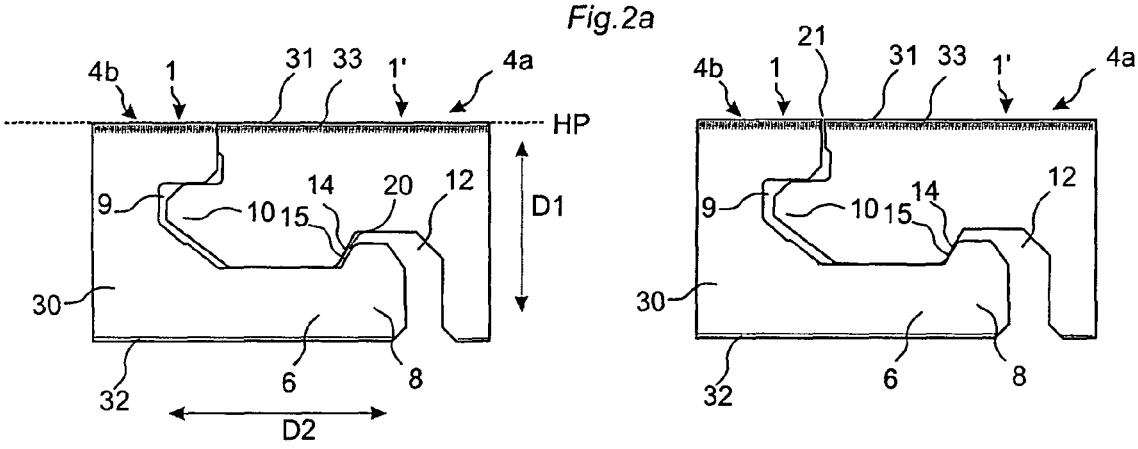
FIGS. 2*a*-2*f* show locking systems and laying patterns.
Figure 2B:
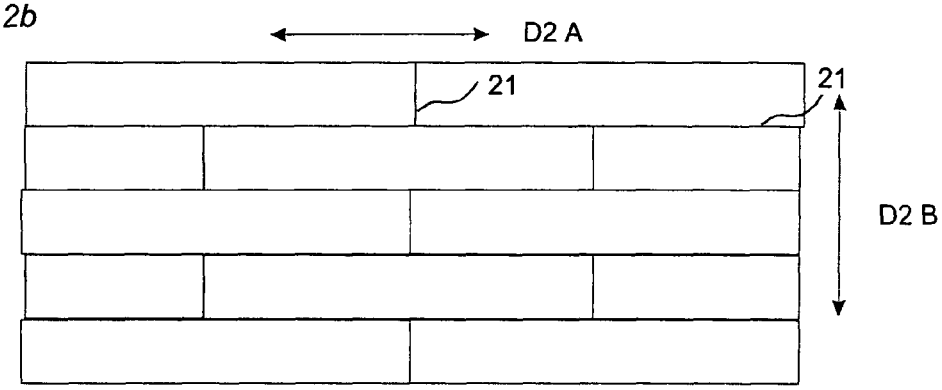

FIG. 2*a* shows the connectors of two floorboards 1, 1' that are joined to each other. In this embodiment, the floorboards have a surface layer 31 of laminate, a core 30 of, for instance, HDF, which is softer and more compressible than the surface layer 31, and a balancing layer 32. The vertical locking D1 comprises a tongue groove 9, which cooperates with a tongue 10. The horizontal locking D2 comprises a strip 6 with a locking element 8, which cooperates with a locking groove 12. This locking system can be joined by inward angling along upper joint edges. It could also be modified in such a way that it could be locked by horizontal snapping. The locking element 8 and the locking groove 12 have cooperating locking surfaces 15, 14. The floorboards can, when joined and pressed against each other in the horizontal direction D2, assume a position where there is a play 20 between the locking surfaces 14, 15. FIG. 2*b* show that when the floorboards are pulled apart in the opposite direction, and when the locking surfaces 14, 15 are in complete contact and pressed against each other, a joint gap 21 arises in the front side between the upper joint edges. The play between the locking surfaces 14, 15 are defined as equal to the displacement of the upper joint edges when these edges are pressed together and pulled apart as described above. This play in the locking system is the maximum floor movement that takes place when the floorboards are pressed together and pulled apart with a pressure and pulling force adapted to the strength of the edge portions and the locking system. Floorboards with hard surface layers or edges, which when pressed together are only compressed marginally, will according to this definition have a play, which is essentially equal or slightly larger than the join gap. Floorboards with softer edges will have a play which is considerable larger than the joint gap. According to this definition, the play is always larger or equal to the joint gap. The play and joint gap can be, for example, 0.05-0.10 mm. Joint gaps, which are about 0.1 mm, are considered acceptable. They are difficult to see and normal dirt particles are too big to penetrate into the locking system through such small joint gaps. In some applications joint gaps up to 0.20 mm, with a play of for example 0.25 mm could be accepted, especially if play and joint gaps are measured when a considerable pressure and pulling force is used. This maximum joint gap will occur in extreme conditions only when the humidity is very low, for example below 20% and when the load on the floor is very high. In normal condition and applications the joint gap in such a floor could be 0.10 mm or less.

FIG. 2*b* shows an ordinary laminate floor with floorboards in the size of 1.2*0.2 m, which are installed in parallel rows. Such a laminate floor shrinks and swells about 1 mm per meter. If the locking system has a play of about 0.1 mm, the five joints in the transverse direction D2 B will allow swelling and shrinking of 5*0.1=0.5 mm per meter. This compensates for only half the maximum swelling or shrinking of 1 mm. In the longitudinal direction D2 A, there is only one joint per 1.2 m, which allows a movement of 0.1 mm. The play 20 and the joint gap 21 in the locking system thus contribute only marginally to reduce shrinking and swelling of the floor in the direction D2 parallel to the long sides. To reduce the movement of the floor to half of the movement that usually occurs in a floor without play 20 and joint gap 21, it is necessary to increase the play 20 to 0.6 mm, and this results in too big a joint gap 21 on the short side.

Figure 2C:
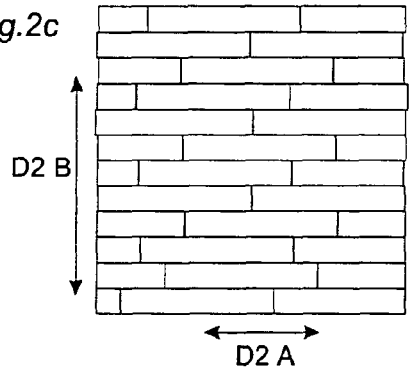

FIG. 2*c* shows floorboards with, for instance, a core 30 of fiberboard, such as HDF, and a surface layer of laminate or veneer, which has a maximum dimensional change of about 0.1%, i.e., 1 mm per meter. The floorboards are installed in parallel rows. In this embodiment, they are narrow and short with a size of, for example, 0.5*0.08 m. If the play is 0.1 mm, 12 floorboards with their 12 joints over a floor length of one meter will allow a movement in the transverse direction D2 B of 1.2 mm, which is more than the maximum dimensional change of the floor. Thus the entire movement may occur by the floorboards moving relative to each other, and the outer dimensions of the floor can be unchanged. In the longitudinal direction D2 A, the two short side joints can only compensate for a movement of 0.2 mm per meter. In a room which is, for example, 10 m wide and 40 m long, installation can suitably occur, contrary to the present recommended installation principles, with the long sides of the floorboards parallel to the width direction of the room and perpendicular to the length direction thereof. According to this preferred embodiment, a large continuous floating floor surface without large visible joint gaps can thus be provided with narrow floorboards which have a locking system with play and which are joined in parallel rows perpendicular to the length direction of the floor surface. The locking system, the floorboards and the installation pattern should thus be adjusted so that a floor surface of 1*1 m can expand and be pressed together about 1 mm or more in at least one direction without damaging the locking system or the floorboards. A mechanical locking system in a floating floor which is installed in home settings should have a mechanical locking system that withstands tensile load and compression corresponding to at least 200 kg per meter of floor length. More specifically, it should preferably be possible to achieve the above change in shape without visible joint gaps when the floor surface above is subjected to a compressive or tensile load of 200 kg in any direction and when the floorboards are conditioned in normal relative humidity of about 45%.

The strength of a mechanical locking system is of great importance in large continuous floating floor surfaces. Such large continuous surfaces are defined as a floor surface with length and/or width exceeding 12 m. Very large continuous surfaces are defined as floor surfaces with length and/or width exceeding 20 m. There is a risk that unacceptable joint gaps will occur or that the floorboards will slide apart, if the mechanical locking system is not sufficiently strong in a large floating floor. Dimensionally stable floorboards, such as laminate floors, which show average joint gaps exceeding 0.2 mm, when a tensile load of 200 kg/m is applied, are generally not suitable to use in a large high quality floating floor. The invention could be used to install continuous floating floors with a length and/or width exceeding 20 m or even 40 m. In principle there are no limitations. Continuous floating floors with a surface of 10,000 $m^2$ or more could be installed according to invention.

Such new types of floating floors where the major part of the floating movement, in at least one direction, takes place between the floorboards and in the mechanical locking system are hereafter referred to as Semi-floating Floors.

FIG. 5*d* illustrates a suitable testing method in order to ensure that the floorboards are sufficiently mobile in the joined state and that the locking system is strong enough to be used in a large continuous floating floor surface where the floor is a Semi Floating Floor. In this example, 9 samples with 10 joints and with a length L of 100 mm (10% of 1 meter) have been joined along their respective long sides so as to correspond to a floor length TL of about 1 meter. The amount of joints, in this example, 10 joints, is referred to as Nj. The boards are subjected to compressive and tensile load using a force F corresponding to 20 kg (200 N), which is 10% of 200 kg. The change in length of the floor length TL, hereafter referred to as Δ TL, should be measured. The average play, hereafter referred to as AP or floor movement per joint is defined as AP=Δ TL/Nj. If for example Δ TL=1.5 mm, than the average play AP=1.5/10=0.15 mm. This testing method will also measure dimensional changes of the floorboard. Such dimensional changes are in most floorboards extremely small compared to the play. As mentioned before, due to compression of top edges and eventually some very small dimensional changes of the floor board itself, the average joint gap will always be smaller than the average play AP. This means that in order to make sure that the floor movement is sufficient (Δ TL) and that the average joint gaps 21 do not exceed the stipulated maximum levels, only Δ TL has to be measured and controlled, since Δ TL/Nj is always larger or equal to the average joint gap 21. The size of the actual average joint gap 21 in the floor, when the tensile force F is applied, could however be measured directly for example with a set of thickness gauges or a microscope and the actual average joint gap=AAJG could be calculated. The difference between AP and AAJG is defined as floorboard flexibility=FF (FF=AP−AAJG). In a laminate floor ΔTL should preferably exceed 1 mm. Lower or higher force F could be used to design floorboards, installation patterns and locking systems which could be used as Semi Floating Floors. In some applications for example in home environment with normal moisture conditions a force F of 100 kg (1000 N) per meter could be sufficient. In very large floating floors a force F of 250-300 kg or more could be used. Mechanical locking systems could be designed with a locking force of 1000 kg or more. The joint gap in such locking systems could be limited to 0.2 mm even when a force F of 400-500 kg is applied. The pushback effect caused by the locking element 8, the locking surfaces 15,14 and the locking strip 6 could be measured by increasing and decreasing the force F in steps of for example 100 kg. The pushback effect is high If Δ TL is essentially the same when F is increased from 0 to 100 kg (=Δ TL1) as when F is increased from 0 to 200 kg and than decreased back to 100 kg (=Δ TL2). A mechanical locking system with a high pushback effect is an advantage in a semi-floating floor. Preferably Δ TL1 should be at least 75% of Δ TL2. In some applications even 50% could be sufficient.

Figure 2D:
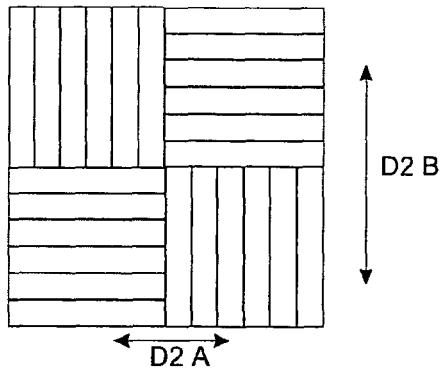

FIG. 2*d* shows floorboards according to FIG. 2*c* which are installed in a diamond pattern. This method of installation results in 7 joints per running meter in both directions D2 A and D2 B of the floor. A play of 0.14 mm can then completely eliminate a swelling and shrinking of 0.1% since 7 joints result in a total mobility of 7*0.14=1.0 mm.

Figure 2E:
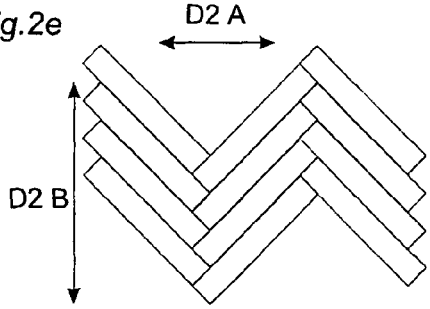
Figure 2F:
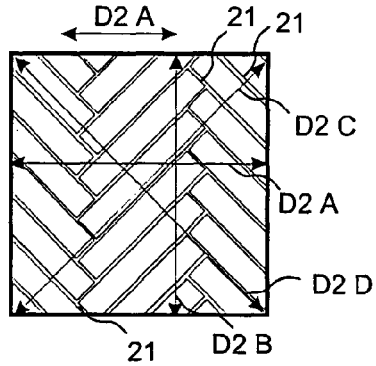

FIG. 2*e* shows floor surface of one square meter which consists of the above-described floorboards installed in a herringbone pattern long side against short side and shows the position of the floorboards when, for instance, in summer they have swelled to their maximum dimension. FIG. 2*f* shows the position of the floorboards when, for instance, in winter, they have shrunk. The locking system with the inherent play then results in a joint gap 21 between all joint edges of the floorboards. Since the floorboards are installed in a herringbone pattern, the play of the long sides will help to reduce the dimensional changes of the floor in all directions. FIG. 2*f* also shows that the critical direction is the diagonal directions D2 C and D2 D of the floor where 7 joint gaps must be adjusted so as to withstand a shrinkage over a distance of 1.4 m. This can be used to determine the optimal direction of laying in a large floor. In this example, a joint gap of 0.2 mm will completely eliminate the movement of the floor in all directions. This allows the outer portions of a floating floor to be attached to the subfloor, for example, by gluing, which prevents the floor, when shrinking, to be moved outside the baseboards. The invention also allows partition walls to be attached to an installed floating floor, which can reduce the installation time.

Practical experiments demonstrate that a floor with a surface of veneer or laminate and with a core of a fiberboard-based panel, for instance a dimensionally stable high quality HDF, can be manufactured so as to be highly dimensionally stable and have a maximum dimensional change in home settings of about 0.5-1.0 mm per meter. Such semi-floating floors can be installed in spaces of unlimited size, and the maximum play can be limited to about 0.1 mm also in the cases where the floorboards have a width of preferably about 120 mm. It goes without saying that still smaller floorboards, for instance 0.4*0.06 m, are still more favorable and can manage large surfaces also when they are made of materials that are less stable in shape. According to a first embodiment, a new type of semi-floating floor where the individual floorboards are capable of moving and where the outer dimensions of the floor need not be changed. This can be achieved by optimal utilization of the size of the boards, the mobility of the locking system using a small play and a small joint gap, and the installation pattern of the floorboards. A suitable combination of play, joint gap, size of the floorboard, installation pattern and direction of laying of the floorboards can thus be used in order to wholly or partly eliminate movements in a floating floor. Much larger continuous floating floors can be installed than is possible today, and the maximum movement of the floor can be reduced to the about 10 mm that apply to current technology, or be completely eliminated. All this can occur with a joint gap which in practice is not visible and which is not different, regarding moisture and dirt penetration, from traditional 0.2 m wide floating floorboards which are joined in parallel rows by pretension or with a very small displacement play which does not give sufficient mobility. As a non-limiting example, it can be mentioned that the play 20 and the joint gap 21 in dimensionally stable floors should preferably be about 0.1-0.2 mm.

An especially preferred embodiment according to the invention is a semi-floating floor with the following characteristics: The surface layer is laminate or wood veneer, the core of the floorboard is a wood based board such as MDF or HDF, the change in floor length Δ TL is at least 1.0 mm when a force F of 100 kg/m is used, the change in floor length Δ TL is at least 1.5 mm when a force F of 200 kg/m is used, average joint gaps do not exceed 0.15 mm when the force F is 100 kg/m and they do not exceed 0.20 mm when the force F is 200 kg/m.

The function and joint quality of such semi-floating floorboards will be similar to traditional floating floorboards when humidity conditions are normal and the size of the floor surface is within the generally recommended limits. In extreme climate conditions or when installed in a much larger continuous floor surface, such semi-floating floorboard will be superior to the traditional floorboards. Other combinations of force F, change in floor length Δ TL and joint gap 21 could be used in order to design a semi-floating floor for various application.

Figure 3A:
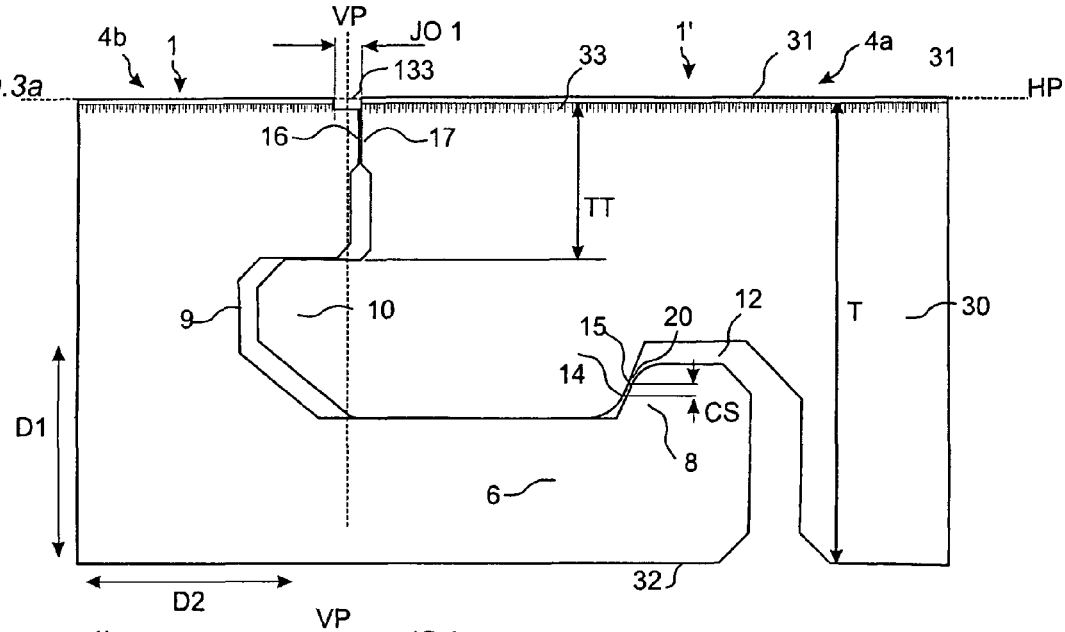
FIGS. 3*a*-3*e* show locking systems.

FIG. 3*a* shows a second embodiment, which can be used to counteract the problems caused by movements due to moisture in floating floors. In this embodiment, the floorboard has a surface 31 of direct laminate and a core of HDF. Under the laminate surface, there is a layer 33, which consists of melamine impregnated wood fibers. This layer forms, when the surface layer is laminated to HDF and when melamine penetrates into the core and joins the surface layer to the HDF core. The HDF core 30 is softer and more compressible than the laminate surface 31 and the melamine layer 33. According to the invention, the surface layer 31 of laminate and, where appropriate, also parts of, or the entire, melamine layer 33 under the surface layer can be removed so that a decorative groove 133 forms in the shape of a shallow joint opening JO 1. This joint opening resembles a large joint gap in homogeneous wooden floors. The groove 133 can be made on one joint edge only, and it can be colored, coated or impregnated in such a manner that the joint gap becomes less visible. Such decorative grooves or joint openings can have, for example, a width JO 1 of, for example, 1-3 mm and a depth of 0.2-0.5 mm. In some application the width of JO 1 could preferably be rather small about 0.5-1.0 mm When the floorboards 1, 1' are pressed towards each other, the upper joint edges 16, 17 can be compressed. Such compression can be 0.1 mm in HDF. Such a possibility of compression can replace the above-mentioned play and can allow a movement without a joint gap. Chemical processing as mentioned above can also change the properties of the joint edge portion and help to improve the possibilities of compression. Of course, the first and second embodiment can be combined. With a play of 0.1 mm and a possibility of compression of 0.1 mm, a total movement of 0.2 mm can be provided with a visible joint gap of 0.1 mm only. Compression can also be used between the active locking surfaces 15, 14 in the locking element 8 and in the locking groove 12. In normal climatic conditions the separation of the floorboards is prevented when the locking surfaces 14, 15 are in contact with each other and no substantial compression occurs. When subjected to additional tensile load in extreme climatic conditions, for instance when the RH falls below 25%, the locking surfaces will be compressed. This compression is facilitated if the contact surface CS of the locking surfaces 14, 15 are small. It is advantageous if this contact surface CS in normal floor thicknesses 8-15 mm is about 1 mm or less. With this technique, floorboards can be manufactured with a play and joint gap of about 0.1 mm. In extreme climatic conditions, when the RH falls below 25% and exceeds 80%, compression of upper joint edges and locking surfaces can allow a movement of for instance 0.3 mm. The above technique can be applied to many different types of floors, for instance floors with a surface of high pressure laminate, wood, veneer and plastic and like materials. The technique is particularly suitable in floorboards where it is possible to increase the compression of the upper joint edges by removing part of the upper joint edge portion 16 and/or 17.

Figure 3B:
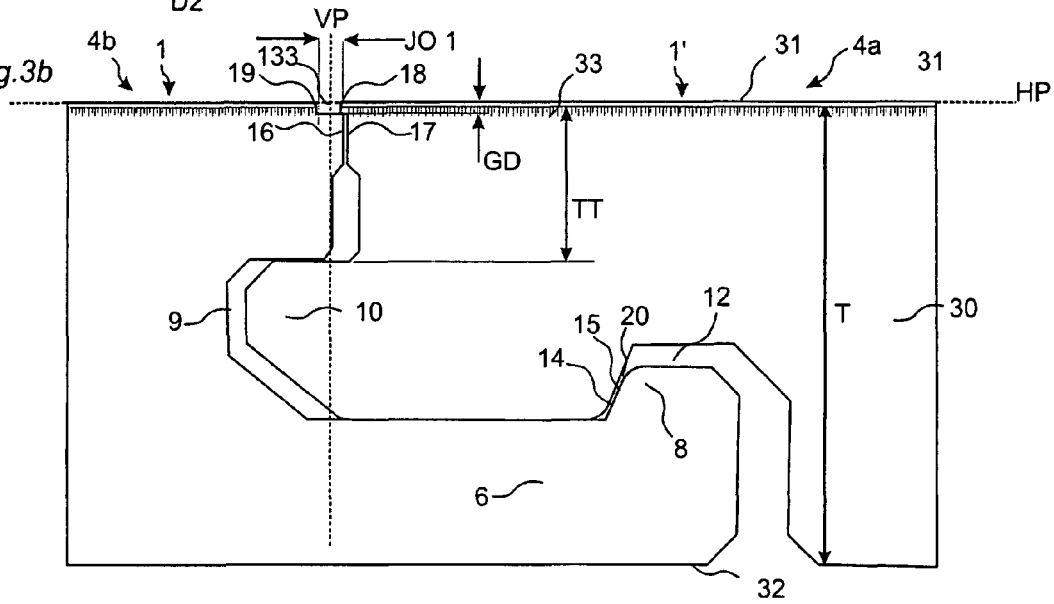
Figure 3C:
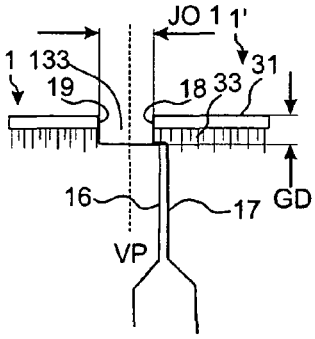
Figure 3D:
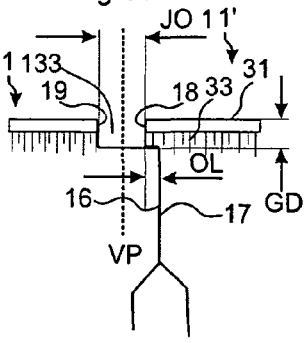

FIG. 3*b* illustrates a third embodiment. FIG. 3*c* and 3*d* are enlargements of the joint edges in FIG. 3*b*. The floorboard 1' has, in an area in the joint edge which is defined by the upper parts of the tongue 10 and the groove 9 and the floor surface 31, an upper joint edge portion 18 and a lower joint edge portion 17, and the floorboard 1 has in a corresponding area an upper joint edge portion 19 and a lower joint edge portion 16. When the floorboards 1, 1' are pressed together, the lower joint edge portions 16, 17 will come into contact with each other. This is shown in FIG. 3*d*. The upper joint edge portions 18, 19 are spaced from each other, and one upper joint edge portion 18 of one floorboard 1' overlaps the lower joint edge portion 16 of the other floorboard 1. In this pressed-together position, the locking system has a play 20 of for instance 0.2 mm between the locking surfaces 14, 15. If the overlap in this pressed-together position is 0.2 mm, the boards can, when being pulled apart, separate from each other 0.2 mm without a visible joint gap being seen from the surface. This embodiment will not have an open joint gap because the joint gap will be covered by the overlapping joint edge portion 18. This is shown in FIG. 3*c*. It is an advantage if the locking element 8 and the locking grove 12 are such that the possible separation i.e. e. the play is slightly smaller then the overlapping. Preferably a small overlapping, for example 0.05 mm should exist in the joint even when the floorboards are pulled apart and a pulling force F is applied to the joint. This overlapping will prevent moisture to penetrate into the joint. The joint edges will be stronger since the lower edge portion 16 will support the upper edge portion 18. The decorative groove 133 can be made very shallow and all dirt collecting in the groove can easily be removed by a vacuum cleaner in connection with normal cleaning. No dirt or moisture can penetrate into the locking system and down to the tongue 12. This technique involving overlapping joint edge portions can, of course, be combined with the two other embodiments on the same side or on long and short sides. The long side could for instance have a locking system according to the first embodiment and the short side according to the second. For example, the visible and open joint gap can be 0.1 mm, the compression 0.1 mm and the overlap 0.1 mm. The floorboards' possibility of moving will then be 0.3 mm all together and this considerable movement can be combined with a small visible open joint gap and a limited horizontal extent of the overlapping joint edge portion 18 that does not have to constitute a weakening of the joint edge. This is due to the fact that the overlapping joint edge portion 18 is very small and also made in the strongest part of the floorboard, which consists of the laminate surface, and melamine impregnated wood fibers. Such a locking system, which thus can provide a considerable possibility of movement without visible joint gaps, can be used in all the applications described above. Furthermore the locking system is especially suitable for use in broad floorboards, on the short sides, when the floorboards are installed in parallel rows and the like, i.e., in all the applications that require great mobility in the locking system to counteract the dimensional change of the floor. It can also be used in the short sides of floorboards, which constitute a frame FR, or frieze round a floor installed in a herringbone pattern according to FIG. 5*c*. In this embodiment, shown in FIGS. 3*b*-3*d*, the vertical extent of the overlapping joint edge portion, i.e., the depth GD of the joint opening, is less than 0.1 times the floor thickness T. An especially preferred embodiment according to the invention is a semi-floating floor with the following characteristics: The surface layer is laminate or wood veneer, the core of the floorboard is a wood based board such as MDF or HDF, the floor thickness T is 6-9 mm and the overlapping OL is smaller than the average play AP when a force F of 100 kg/m is used. As an example it could be mentioned that the depth GD of the joint opening could be 0.2-0.5 mm (=0.02*T−0.08 T). The overlapping OL could be 0.1-0.3 mm (=0.01*T−0.05*T) on long sides. The overlapping OL on the short sides could be equal or larger than the overlapping on the long sides.

Figure 3E:
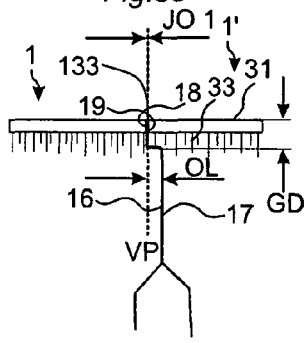

FIG. 3*e* show an embodiment where the joint opening JO 1 is very small or nonexistent when the floorboards are pressed together. When the floorboards are pulled apart, a joint opening JO 1 will occur. This joint opening will be substantially of the same size as the average play AP. The decorative groove could for example be colored in some suitable design matching the floor surface and a play will not cause an open joint gap. A very small overlapping OL of some 0.1 mm (0.01*T−0.02*T) only and slightly smaller average play AP could give sufficient floor movement and this could be combined with a moisture resistant high quality joint. The play will also facilitate locking, unlocking and displacement in locked position. Such overlapping edge portions could be used in all known mechanical locking systems in order to improve the function of the mechanical locking system.

Figure 4A:
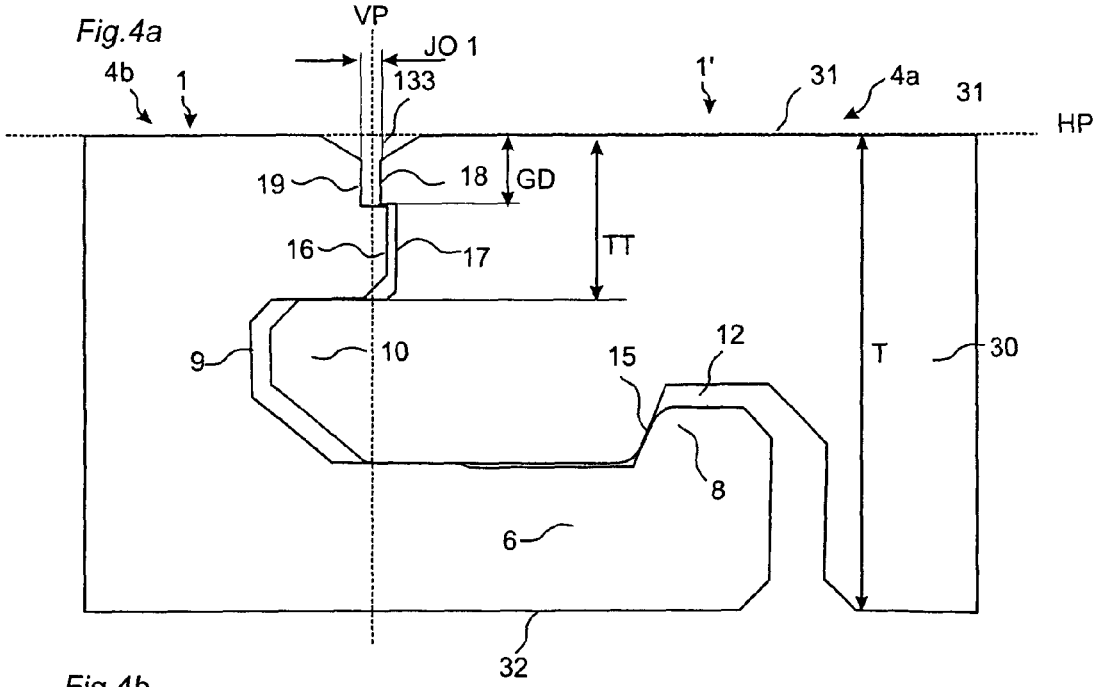
FIGS. 4*a*-4*c* show locking systems.
Figure 4B:
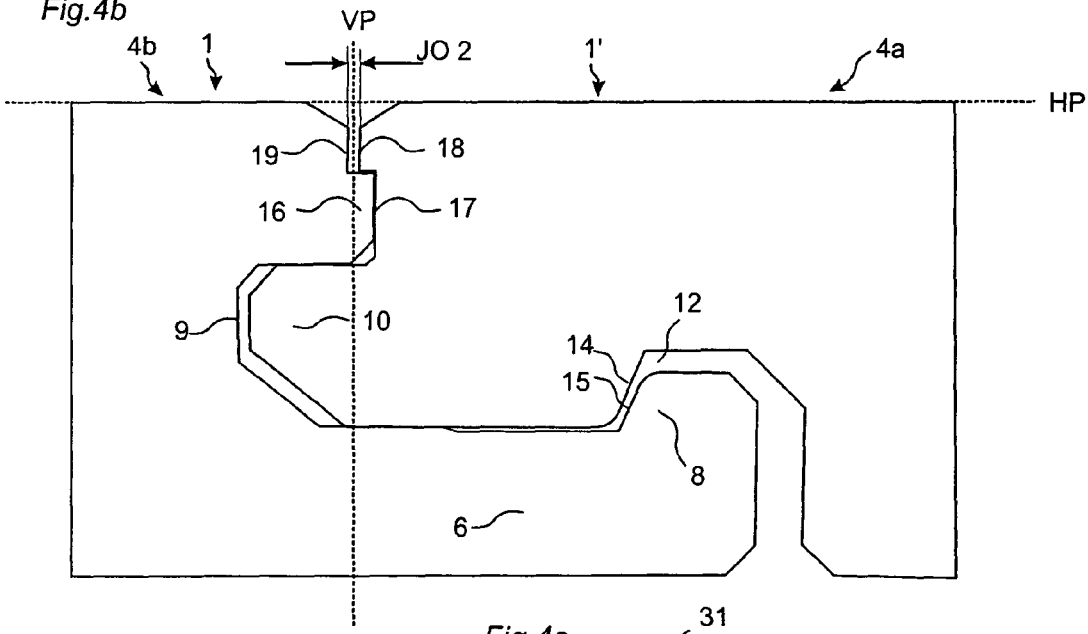

FIGS. 4*a* and 4*b* show how a locking system can be designed so as to allow a floating installation of floor-boards, which comprise a moisture sensitive material. In this embodiment, the floorboard is made of homogeneous wood.

Figure 4C:
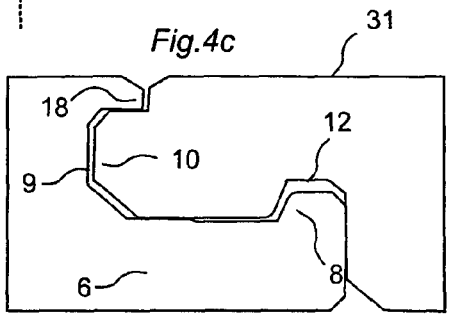

FIG. 4*a* shows the locking system in a state subjected to tensile load, and FIG. 4*b* shows the locking system in the compressed state. For the floor to have an attractive appearance, the relative size of the joint openings should not differ much from each other. To ensure that the visible joint openings do not differ much while the floor moves, the smallest joint opening JO 2 should be greater than half the greatest joint opening JO 1. Moreover, the depth GD should preferably be less than 0.5*TT, TT being the distance between the floor surface and the upper parts of the tongue/groove. In the case where there is no tongue, GD should be less than 0.2 times the floor thickness T. This facilitates cleaning of the joint opening. It is also advantageous if JO 1 is about 1-5 mm, which corresponds to normal gaps in homogeneous wooden floors. According to the invention, the overlapping joint edge portion should preferably lie close to the floor surface. This allows a shallow joint opening while at the same time vertical locking can occur using a tongue 10 and a groove 9 which are placed essentially in the central parts of the floorboard between the front side and the rear side where the core 30 has good stability. An alternative way of providing a shallow joint opening, which allows movement, is illustrated in FIG. 4*c*. The upper part of the tongue 10 has been moved up towards the floor surface. The drawback of this solution is that the upper joint edge portion 18 above the tongue 10 will be far too weak. The joint edge portion 18 can easily crack or be deformed.

FIGS. 5*a* and 5*b* illustrate the long side joint of three floorboards 1, 1' and 1" with the width W. FIG. 5*a* shows the floorboards where the RH is low, and FIG. 5*b* shows them when the RH is high. To resemble homogeneous floors, broad floorboards should preferably have wider joint gaps than narrow ones. JO 2 should suitably be at least about 1% of the floor width W. 100 mm wide floorboards will then have a smallest joint opening of at least 1 mm. Corresponding joint openings in, for example, 200 mm wide planks should be at least 2 mm. Other combinations can, of course, also be used especially in wooden floors where special requirements are made by different kinds of wood and different climatic conditions.

Figure 6A:
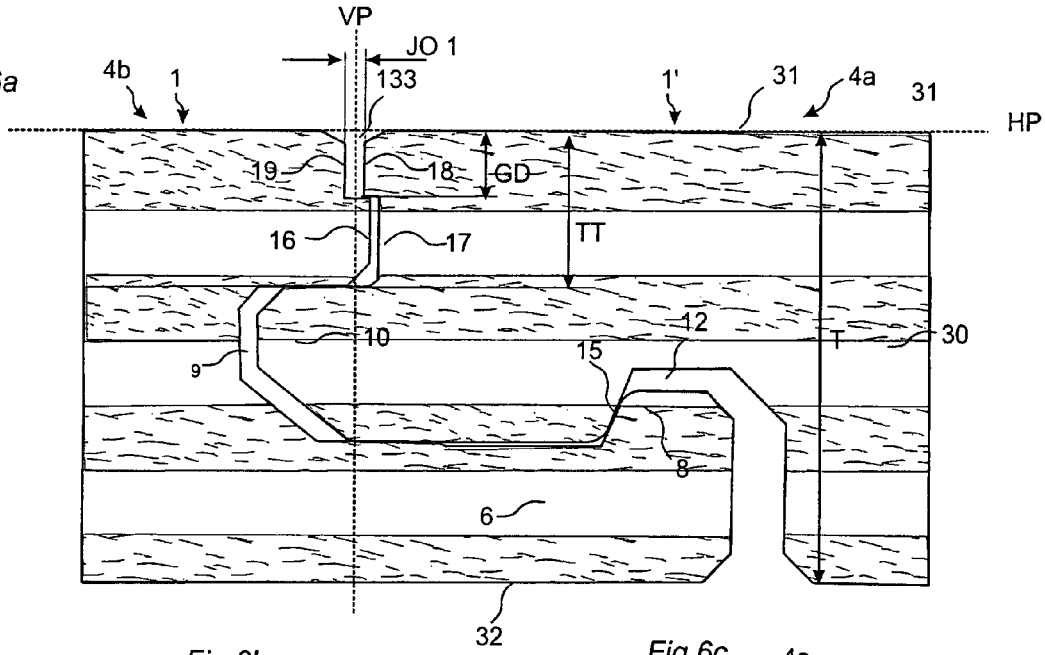
FIGS. 6*a*-6*e* show locking systems.

FIG. 6*a* shows a wooden floor, which consists of several layers of wood. The floorboard may comprise, for example, an upper layer of high-grade wood, such as oak, which constitutes the decorative surface layer 31. The core 30 may comprise, for example, plywood, which is made up of other kinds of wood or by corresponding kinds of wood but of a different quality. Alternatively the core may comprise or wood lamellae. The upper layer 31 has as a rule a different fiber direction than a lower layer. In this embodiment, the overlapping joint edges 18 and 19 are made in the upper layer. The advantage is that the visible joint opening JO 1 will comprise the same kind of wood and fiber direction as the surface layer 31 and the appearance will be identical with that of a homogeneous wooden floor.

Figure 6B:
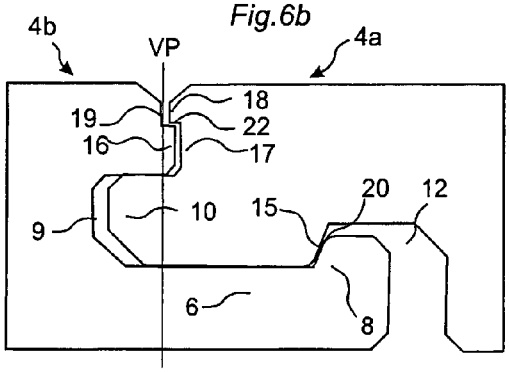
Figure 6C:
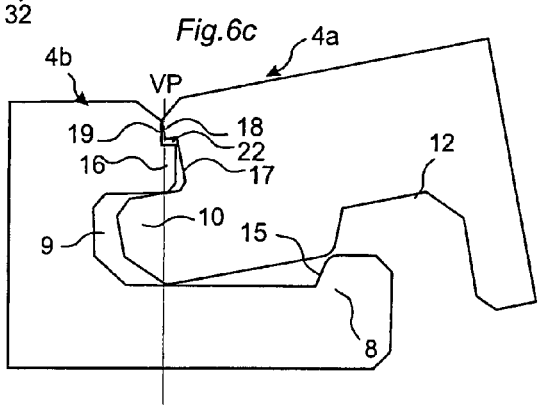

FIGS. 6*b* and 6*c* illustrate an embodiment where there is a small play 22 between the overlapping joint edge portions 16, 18, which facilitate horizontal movement in the locking system. FIG. 6*c* shows joining by an angular motion and with the upper joint edge portions 18, 19 in contact with each other. The play 20 between the locking surface 15 of the locking element 8 and the locking groove 12 significantly facilitates joining by inward angling, especially in wooden floors that are not always straight.

Figure 6D:
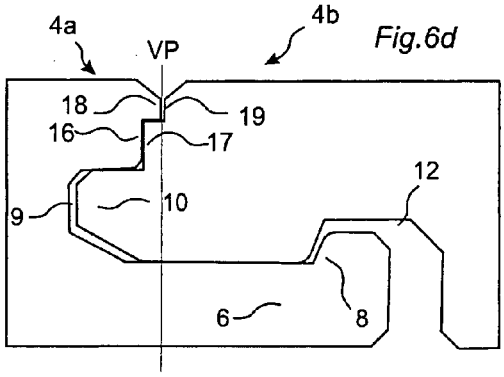
Figure 6E:
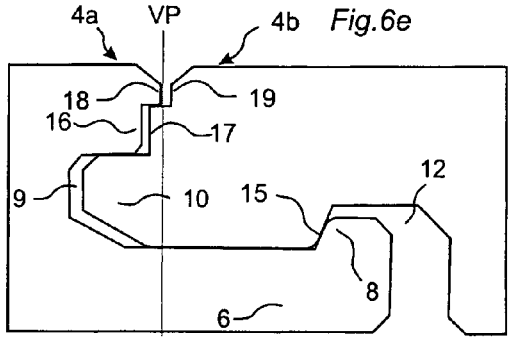

In the above-preferred embodiments, the overlapping joint portion 18 is made in the tongue side, i.e., in the joint edge having a tongue 10. This overlapping joint portion 18 can also be made in the groove side, i.e., in the joint edge having a groove 9. FIGS. 6*d* and 6*e* illustrate such an embodiment. In FIG. 6*d*, the boards are pressed together in their inner position, and in FIG. 6*e* they are pulled out to their outer position.

Figure 7A:
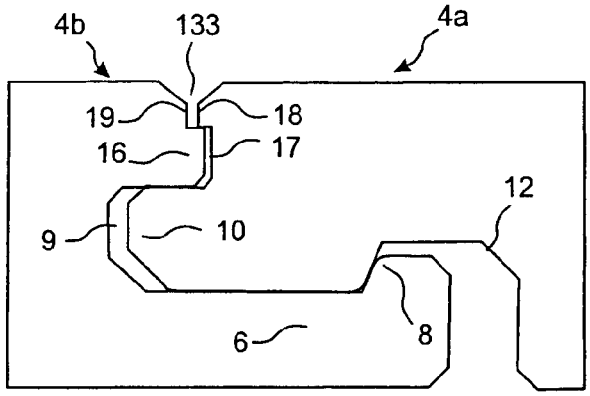
FIGS. 7*a*-7*e* show locking systems.
Figure 7B:
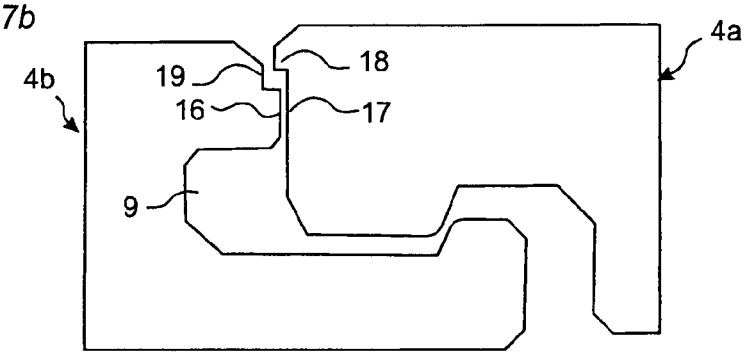
Figure 7C:
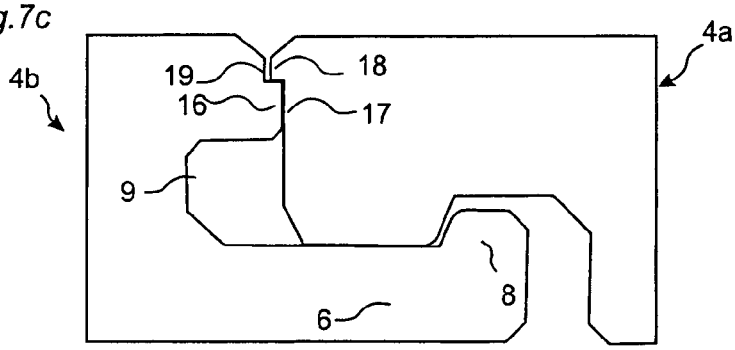
Figure 7D:
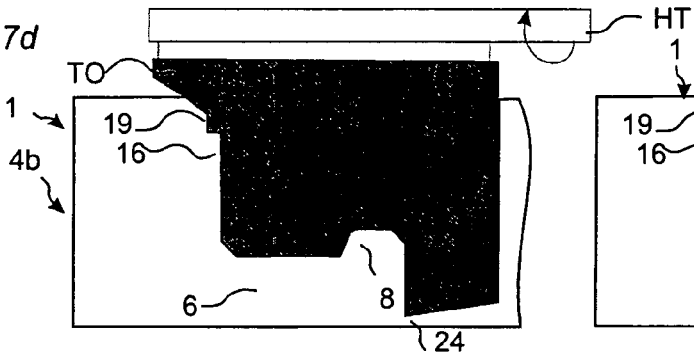
Figure 7E:
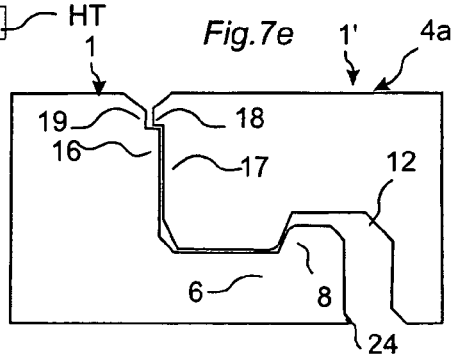

FIGS. 7*a*-7*b* illustrate that it is advantageous if the upper joint edge 18, which overlaps the lower 16, is located on the tongue side 4*a*. The groove side 4*b* can then be joined by a vertical motion to a side 4*a*, which has no tongue, according to FIG. 7*b*. Such a locking system is especially suitable on the short side. FIG. 7*c* shows such a locking system in the joined and pressed-together state. FIGS. 7*d* and 7*e* illustrate how the horizontal locks, for instance in the form of a strip 6 and a locking element 8 and also an upper and lower joint portion 19, 16, can be made by merely one tool TO which has a horizontally operating tool shaft HT and which thus can form the entire joint edge. Such a tool can be mounted, for example, on a circular saw, and a high quality joint system can be made by means of a guide bar. The tool can also saw off the floorboard 1. In the preferred embodiment, only a partial dividing of the floorboard 1 is made at the outer portion 24 of the strip 6. The final dividing is made by the floorboard being broken off. This reduces the risk of the tool TO being damaged by contacting a subfloor of, for instance, concrete. This technique can be used to produce a frame or freize FR in a floor, which, for instance, is installed in a herringbone pattern according to FIG. 5*c*. The tool can also be used to manufacture a locking system of a traditional type without overlapping joint edge portions.

Figure 8A:
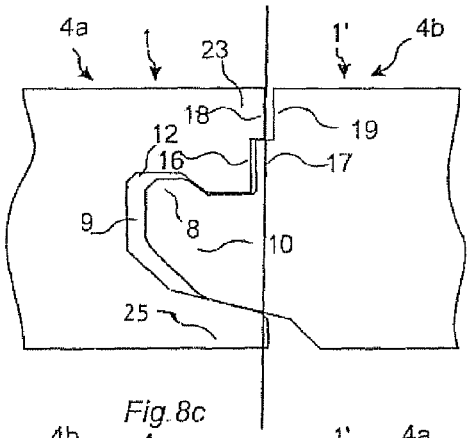
FIGS. 8*a*-8*f* show locking systems.
Figure 8B:
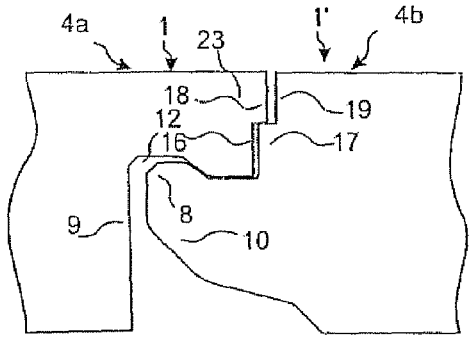
Figure 8C:
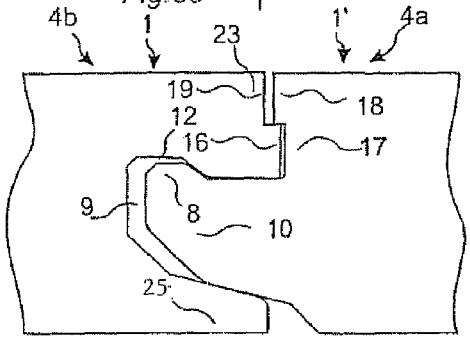
Figure 8D:
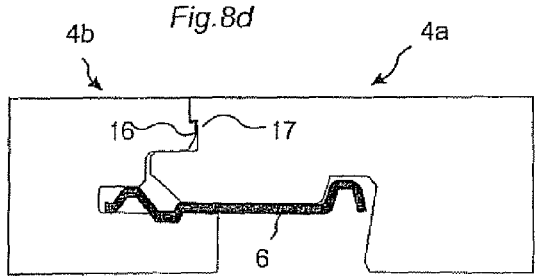
Figure 8E:
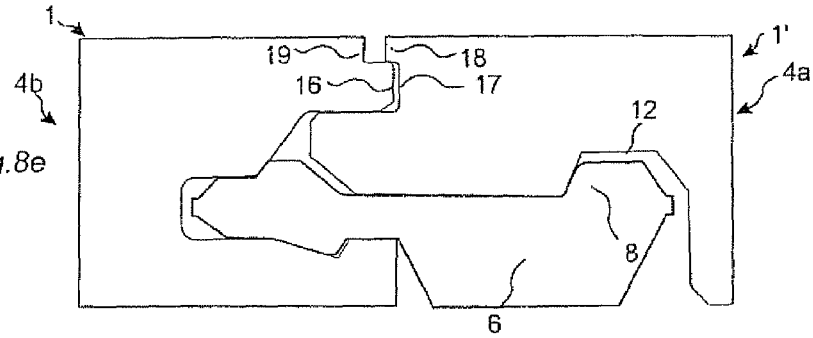

FIGS. 8*a*-8*f* illustrate different embodiments. FIGS. 8*a*-8*c* illustrate how the invention can be used in locking systems where the horizontal lock comprises a tongue 10 with a locking element 8 which cooperates with a locking groove 12 made in a groove 9 which is defined by an upper lip 23 and where the locking groove 12 is positioned in the upper lip 23. The groove also has a lower lip 25 which can be removed to allow joining by a vertical motion. FIG. 8*d* shows a locking system with a separate strip 6, which is made, for instance, of aluminum sheet. FIG. 8*e* illustrates a locking system that has a separate strip 6 which can be made of a fiberboard-based material or of plastic, metal and like materials.

Figure 8F:
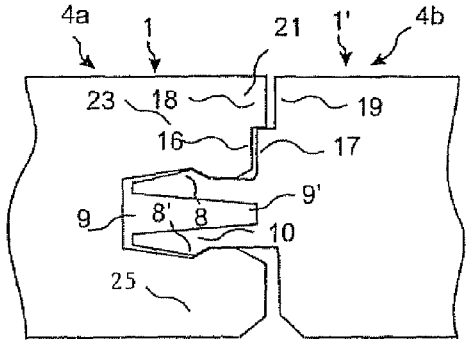

FIG. 8*f* shows a locking system, which can be joined by horizontal snap action. The tongue 10 has a groove 9' which allows its upper and lower part with the locking elements 8, 8' to bend towards each other in connection with horizontally displacement of the joint edges 4*a* and 4*b* towards each other. In this embodiment, the upper and lower lip 23, 24 in the groove 9 need not be resilient. Of course, the invention can also be used in conventional snap systems where the lips 23, 24 can be resilient.

Figure 9A:
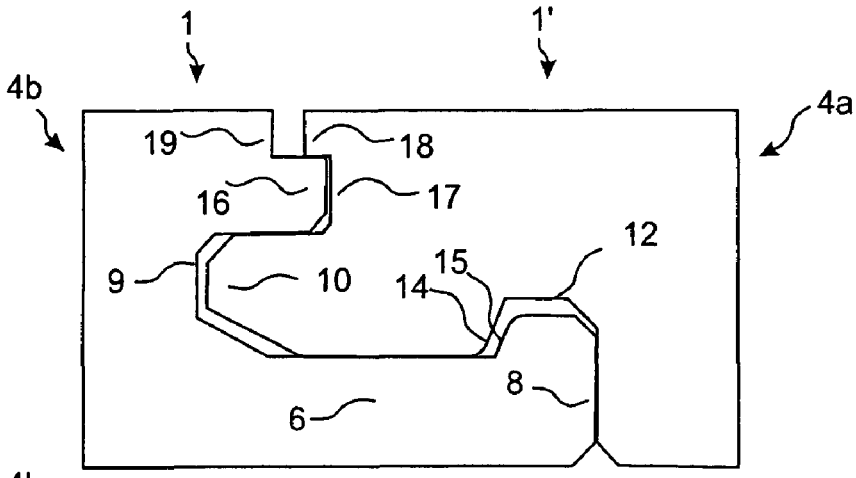
FIGS. 9*a*-9*d* show locking systems.
Figure 9B:
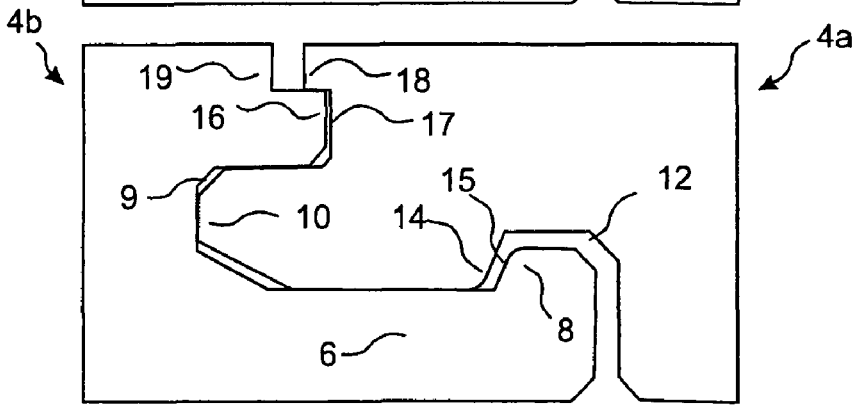
Figure 9C:
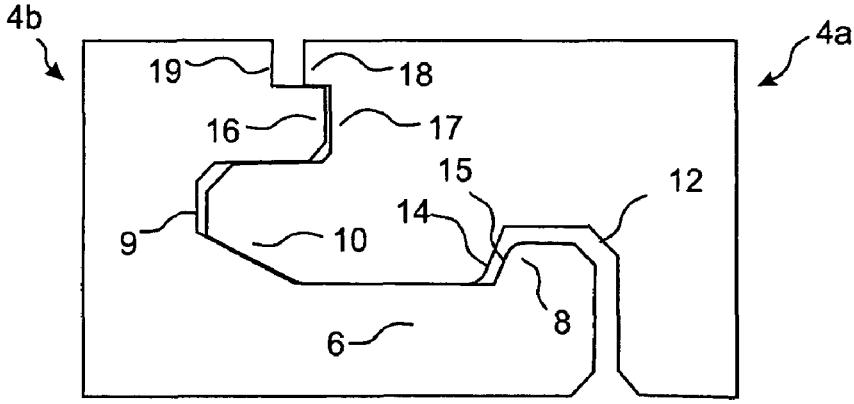
Figure 9D:
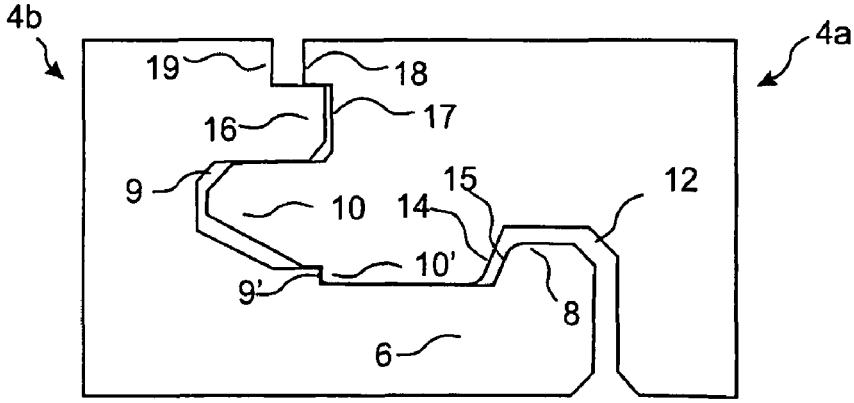

FIGS. 9*a*-9*d* illustrate alternative embodiments of the invention. When the boards are pulled apart, separation of the cooperating locking surfaces 14 and 15 is prevented. When boards are pressed together, several alternative parts in the locking system can be used to define the inner position. In FIG. 9*a*, the inner position of the outer part of the locking element 8 and the locking groove 10 is determined. According to FIG. 9*b*, the outer part of the tongue 10 and the groove 9 cooperate. According to FIG. 9*c* the front and lower part of the tongue 10 cooperates with the groove 9. According to FIG. 9*d*, a locking element 10' on the lower part of the tongue 10 cooperates with a locking element 9' on the strip 6. It is obvious that several other parts in the locking system can be used according to these principles in order to define the inner position of the floorboards.

Figure 10A:
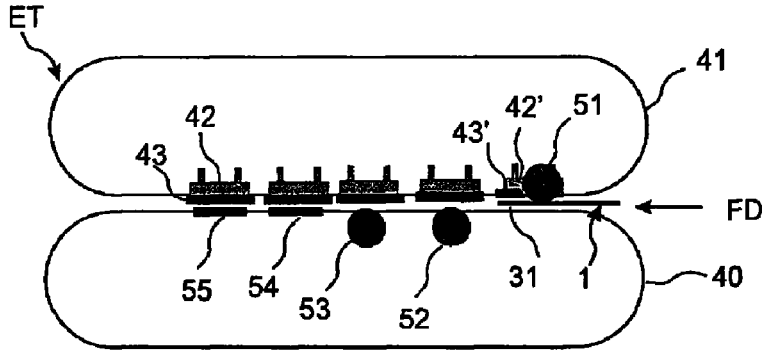
FIGS. 10*a*-10*d* show production equipment
Figure 10B:
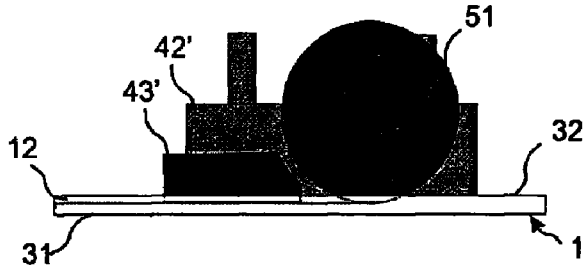
Figure 10C:
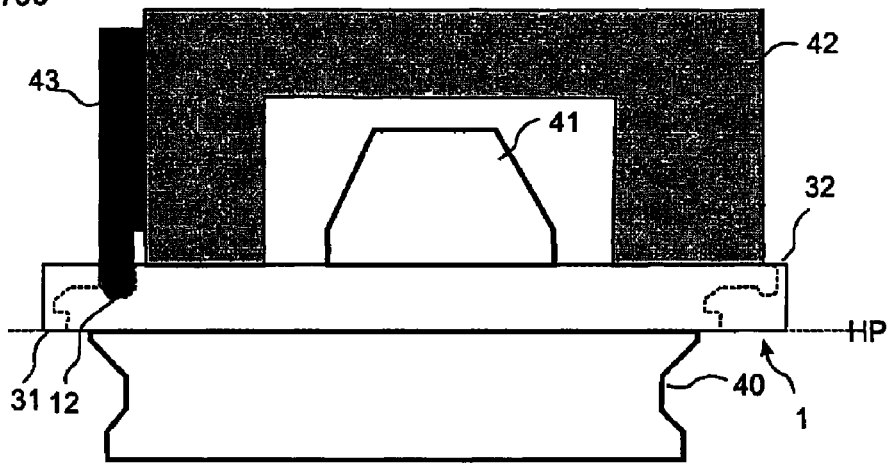
Figure 10D:
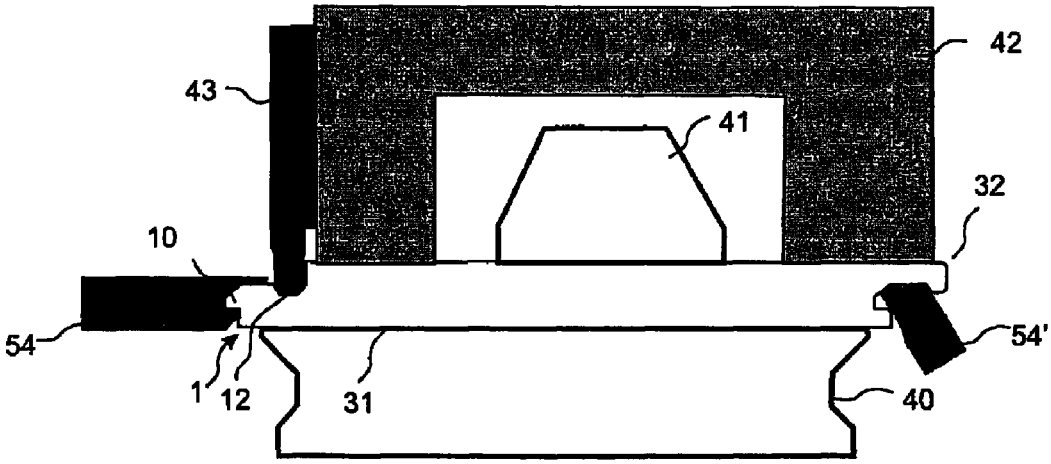
Figure 11A:
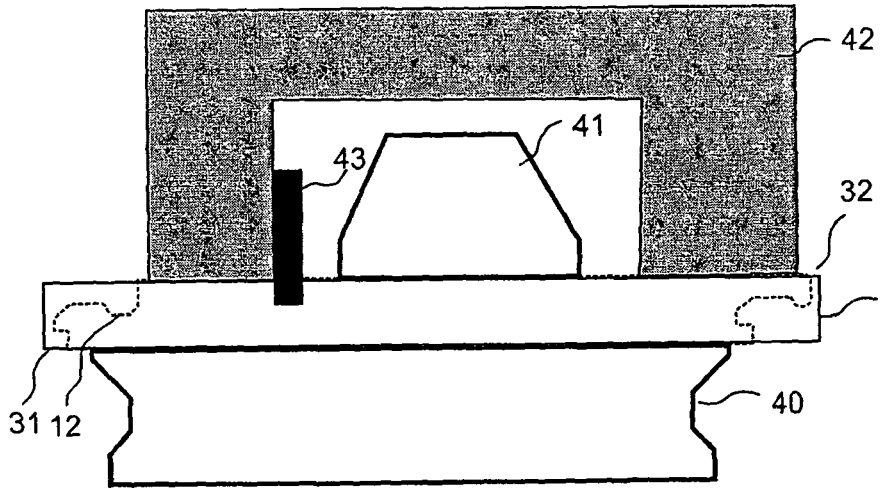
FIGS. 11*a*-11*d* show production equipment
Figure 11B:
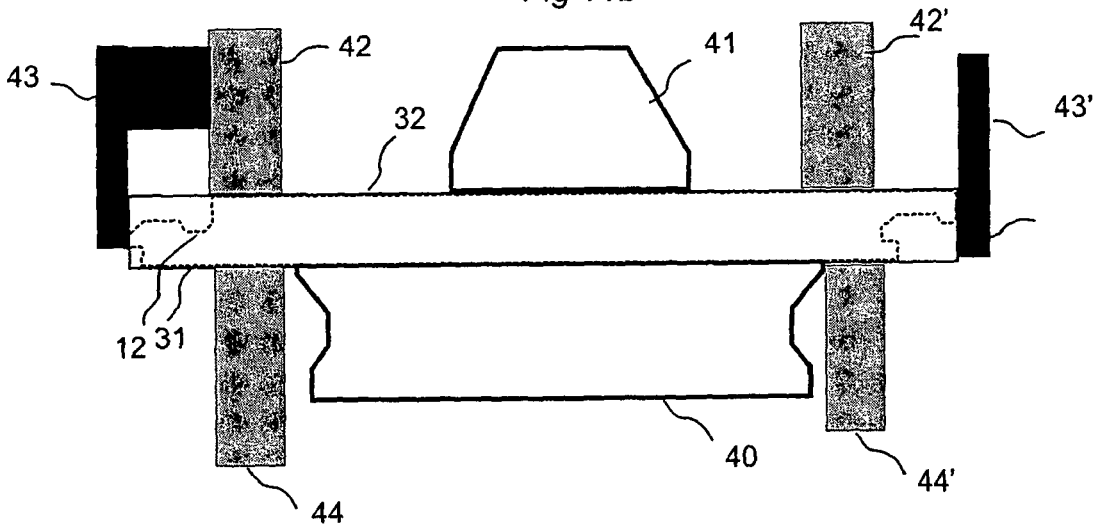
Figure 11C:
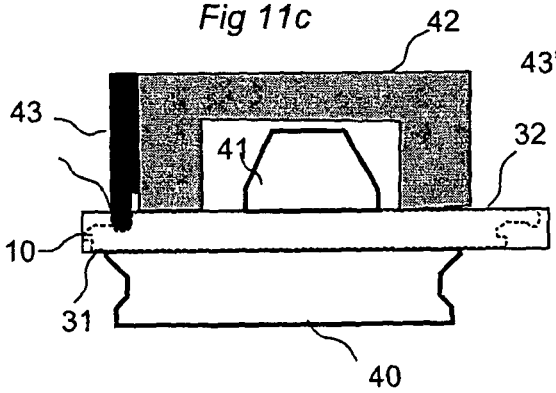
Figure 11D:
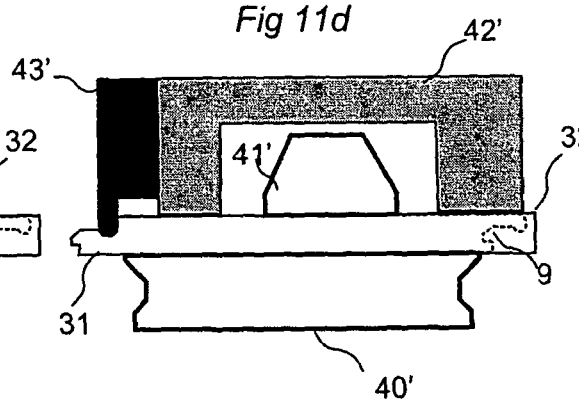

FIG. 10*a* shows production equipments and production methods according to the invention. The end tenor ET has a chain 40 and a belt 41 which displace the floorboard 1 in a feeding direction FD relative a tool set, which in this embodiment has five tools 51,52,53,54 and 55 and pressure shoes 42. The end tenor could also have two chins and two belts. FIG. 10*b* is an enlargement of the first tooling station. The first tool 51 in the tool set makes a guiding surface 12 which in this embodiment is a groove and which is mainly formed as the locking groove 12 of the locking system. Of course other groves could be formed preferably in that part of the floorboard where the mechanical locking system will be formed. The pressure shoe 42' has a guiding device 43' which cooperates with the groove 12 and prevents deviations from the feeding direction FD and in a plane parallel to the horizontal plane. FIG. 10*c* shows the end tenor seen from the feeding direction when the floorboard has passed the first tool 51. In this embodiment the locking groove 12 is used as a guiding surface for the guiding device 43, which is attached to the pressing shoe 42. The FIG. 10*d* shows that the same groove 12 could be used as a guiding surface in all tool stations. FIG. 10*d* shows how the tongue could be formed with a tool 54. The machining of a particular part of the floorboard 1 can take place when this part, at the same time, is guided by the guiding device 43. FIG. 11*a* shows another embodiment where the guiding device is attached inside the pressure shoe. The disadvantage is that the board will have a grove in the rear side. FIG. 11 b shows another embodiment where one or both outer edges of the floorboard are used as a guiding surface for the guiding device 43, 43'. The end tenor has in this embodiment support units 44, 44' which cooperate with the pressure shoes 42,42'. The guiding device could alternatively be attached to this support units 44,44'. FIG. 11*c* and 11*d* shows how a floorboard could be produced in two steps. The tongue side 10 is formed in step one. The same guiding groove 12 is used in step 2 (FIG. 11*d*) when the groove side 9 is formed. Such an end tenor will be very flexible. The advantage is that floorboards of different widths, smaller or larger than the chain width, could be produced.

Figure 12A:
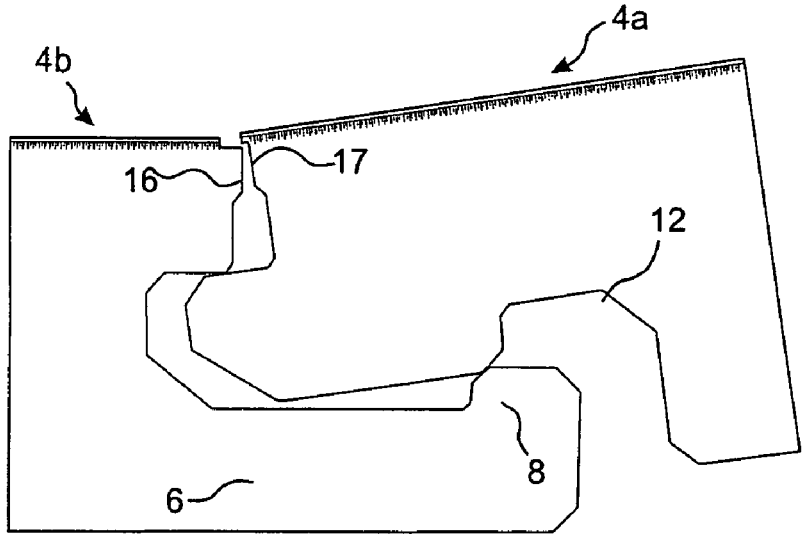
FIGS. 12*a*-12*c* show locking system.
Figure 12B:
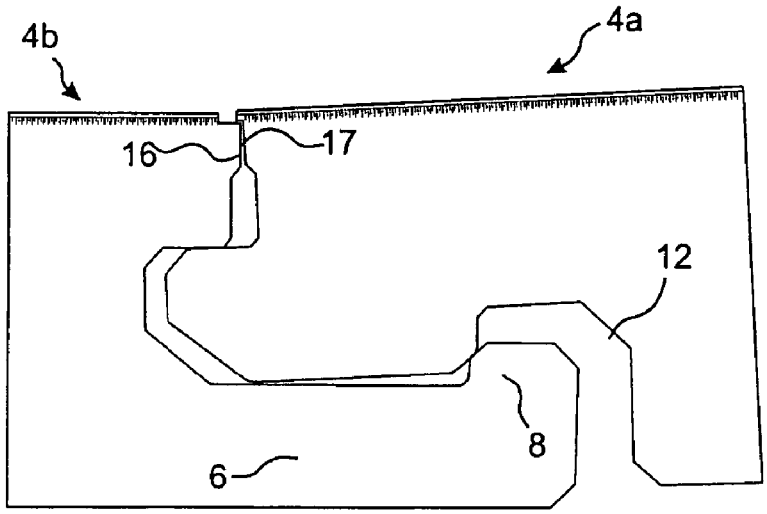
Figure 12C:
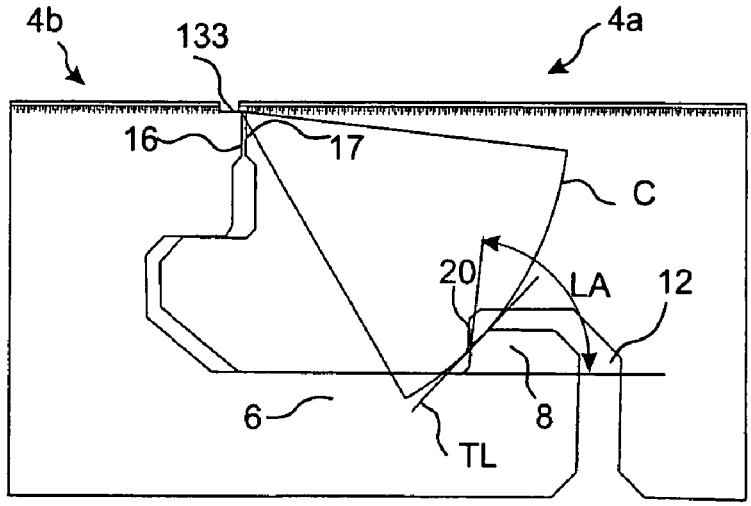

FIGS. 12*a*-12*c* show a preferred embodiment which guaranties that a semi-floating floor will be installed in the normal position which preferably is a position where the actual joint gap is about 50% of the maximum joint gap. If for instance all floorboards are installed with edges 16, 17 in contact, problems may occur around the walls when the floorboards swell to their maximum size. The locking element and the locking groove could be formed in such a way that the floorboards are automatically guided in the optimal position during installation. FIG. 12*c* shows that the locking element 8 in this embodiment has a locking surface with a high locking angle LA close to 90 degree to the horizontal plane. This locking angle LA is higher than the angle of the tangent line TL to the circle C, which has a center at the upper joint edges. FIG. 12*b* shows that such a joint geometry will during angling push the floorboard 4*a* towards the floorboard 4*b* and bring it into the above-mentioned preferred position with a play between the locking element 8 and the locking groove 12 and a joint gap between the top edges 16, 17.

Although only preferred embodiments are specifically illustrated and described herein, it will be appreciated that many modifications and variations of the present invention are possible in light of the above teachings and within the purview of the appended claims without departing from the spirit and intended scope of the invention.

The invention claimed is:

1. Equipment for production of building panels, having a horizontal plane which is parallel with a panel surface, the equipment comprising:

a chain, a belt, a pressure shoe and a tool set, the chain and the belt are arranged to displace the building panels relative to the tool set and the pressure shoe, in a feeding direction, the pressure shoe is arranged to press towards a rear side of the building panels, the tool set is arranged to form an edge portion of the building panels when the building panels are displaced relative to the tool set, wherein one of the tools of the tool set forms a guiding surface in the building panels, the pressure shoe has a guiding device which cooperates with the guiding surface and prevents deviations in a direction perpendicular to the feeding direction and parallel to the horizontal plane, wherein the building panel is a floor board with a mechanical locking system, and wherein the guiding surface comprises a groove, the groove being in an edge portion of the floor board where at least one part of the locking system is formed.

2. The equipment as claimed in claim 1, wherein the tool set comprises milling tools.

3. The equipment as claimed in claim 1, wherein the tool set comprises at least five different tools.

4. The equipment as claimed in claim 3, wherein said groove defines the guiding surface for said at least five different tools.

5. The equipment as claimed in claim 1, wherein the guiding device is attached inside the pressure shoe.

6. The equipment as claimed in claim 5, wherein said groove opens towards a rear side.

7. The equipment as claimed in claim 1, wherein the mechanical locking system comprises a locking element which cooperates with a locking groove and locks the floorboards horizontally parallel to the horizontal plane.

8. Equipment for production of building panels, having a horizontal plane which is parallel with a panel surface, the equipment comprising:

a chain, a belt, a pressure shoe and a tool set, the chain and the belt are arranged to displace the building panels relative to the tool set and the pressure shoe, in a feeding direction, the pressure shoe is arranged to press towards a rear side of the building panels, the tool set is arranged to form an edge portion of the building panels when the building panels are displaced relative to the tool set, wherein one of the tools of the tool set forms a guiding surface in the building panels, the pressure shoe has a guiding device which cooperates with the guiding surface and prevents deviations in a direction perpendicular to the feeding direction and parallel to the horizontal plane, wherein the building panel is a floor board with a mechanical locking system, such locking system comprising a locking element which cooperates with a locking groove and locks the floorboards horizontally parallel to the horizontal plane, and the guiding surface comprises a groove open towards a rear side and the groove being in an edge portion of the floor board where at least one part of the locking system are formed.

9. The equipment as claimed in claim 8, wherein the tool set comprises milling tools.

10. The equipment as claimed in claim 8, wherein the tool set comprises at least five different tools.

11. The equipment as claimed in claim 10, wherein said groove defines the guiding surface for said at least five different tools.

12. The equipment as claimed in claim 8, wherein the guiding device is attached inside the pressure shoe.

13. The equipment as claimed in claim 12, wherein said groove opens towards a rear side.

* * * * *